US012448719B2

(12) United States Patent
Yim et al.

(10) Patent No.: US 12,448,719 B2
(45) Date of Patent: Oct. 21, 2025

(54) WASHING MACHINE

(71) Applicant: SAMSUNG ELECTRONICS CO., LTD., Suwon-si (KR)

(72) Inventors: Yonggyun Yim, Suwon-si (KR); Kwangmin Chun, Suwon-si (KR); Bongjin Ko, Suwon-si (KR); Byeongwoo Kim, Suwon-si (KR); Byengbae Park, Suwon-si (KR); Doyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 153 days.

(21) Appl. No.: 18/511,179

(22) Filed: Nov. 16, 2023

(65) Prior Publication Data

US 2024/0263378 A1 Aug. 8, 2024

Related U.S. Application Data

(63) Continuation of application No. PCT/KR2023/017363, filed on Nov. 2, 2023.

(30) Foreign Application Priority Data

Feb. 2, 2023 (KR) ..... 10-2023-0014487

(51) Int. Cl.
*D06F 39/02* (2006.01)
*D06F 39/08* (2006.01)

(52) U.S. Cl.
CPC ..... *D06F 39/02* (2013.01); *D06F 39/08* (2013.01); *D06F 39/022* (2013.01)

(58) Field of Classification Search
CPC ..... D06F 39/02; D06F 39/022; D06F 39/08
See application file for complete search history.

(56) References Cited

U.S. PATENT DOCUMENTS 11,203,830 B2 * 12/2021 Wang ..... D06F 39/022
11,434,599 B2 9/2022 Lee et al.
(Continued)

FOREIGN PATENT DOCUMENTS

CN 103741432 A 4/2014
CN 107287835 A * 10/2017 ..... D06F 39/022
(Continued)

OTHER PUBLICATIONS

International Search Report dated Feb. 16, 2024 for International Application No. PCT/KR2023/017363.
(Continued)

*Primary Examiner* — Benjamin L Osterhout
(74) *Attorney, Agent, or Firm* — STAAS & HALSEY LLP

(57) ABSTRACT

A washing machine comprises: a housing; a tub in the housing; and a detergent box configured to move in a withdrawal and an insertion direction relative to the housing and including a detergent storage space to store therein a detergent to be supplied to the tub; a first elastic member, and a second elastic member, wherein the first and second elastic members are configured so that, when the detergent box is moved into the housing in the insertion direction, the first and second elastic members press the detergent box in the insertion direction away from a first position and a second position, respectively, the second position being spaced rearward of the first position in the housing, and when the detergent box is moved out of the housing in the withdrawal direction, the first and the second elastic members press the detergent box in the insertion direction.

15 Claims, 22 Drawing Sheets

(56) References Cited

U.S. PATENT DOCUMENTS

| | | | | |
|---|---|---|---|---|
| 2004/0103696 | A1* | 6/2004 | Kim | D06F 39/02 68/3 R |
| 2008/0072630 | A1 | 3/2008 | Je et al. | |
| 2010/0275659 | A1 | 11/2010 | Son et al. | |
| 2011/0095670 | A1 | 4/2011 | Cho et al. | |
| 2016/0153133 | A1* | 6/2016 | Del Pos | D06F 34/28 68/17 R |
| 2017/0233934 | A1* | 8/2017 | Lee | D06F 39/022 68/200 |
| 2020/0232145 | A1* | 7/2020 | Jung | D06F 39/02 |
| 2020/0232147 | A1* | 7/2020 | Jung | D06F 39/02 |
| 2021/0388555 | A1 | 12/2021 | Lee et al. | |

FOREIGN PATENT DOCUMENTS

| | | | | |
|---|---|---|---|---|
| CN | 206815039 | U * | 12/2017 | D06F 33/00 |
| CN | 105063966 | B | 3/2018 | |
| CN | 107488992 | B | 9/2019 | |
| CN | 111379134 | A | 7/2020 | |
| CN | 115074962 | A | 9/2022 | |
| EP | 3269870 | A1 * | 1/2018 | D06F 39/02 |
| EP | 3933093 | B1 * | 8/2023 | D06F 39/02 |
| EP | 4484633 | A1 * | 1/2025 | D06F 39/022 |
| KR | 1992-0010406 | | 11/1992 | |
| KR | 1993-0019446 | | 10/1993 | |
| KR | 20-0173177 | | 3/2000 | |
| KR | 10-2007-0063994 | | 6/2007 | |
| KR | 10-2008-0055157 | A | 6/2008 | |
| KR | 10-2008-0055158 | | 6/2008 | |
| KR | 20-0442445 | Y1 | 11/2008 | |
| KR | 10-1030879 | | 4/2011 | |
| KR | 10-1252168 | B1 | 4/2013 | |
| KR | 10-1580447 | | 12/2015 | |
| KR | 10-2019-0124981 | A | 11/2019 | |
| KR | 10-2020-0041101 | A | 4/2020 | |
| WO | WO-2018113718 | A1 * | 6/2018 | D06F 39/02 |
| WO | WO-2018233577 | A1 * | 12/2018 | D06F 39/02 |
| WO | WO-2019114656 | A1 * | 6/2019 | D06F 39/02 |

OTHER PUBLICATIONS

Written Opinion of the International Searching Authority dated Feb. 16, 2024 for International Application No. PCT/KR2023/017363.

* cited by examiner

WASHING MACHINE

CROSS-REFERENCE TO RELATED APPLICATIONS

This is a continuation application of International Application PCT/KR2023/017363, filed Nov. 2, 2023, which is incorporated herein by reference in its entirety, it being further noted that foreign priority benefit is based upon Korean Patent Application No. 10-2023-0014487, filed Feb. 2, 2023, which is incorporated herein by reference in its entirety.

TECHNICAL FIELD

The present disclosure relates to a washing machine including a detergent box.

BACKGROUND ART

A washing machine is a device that uses a driving force of a motor to agitate laundry, wash water, and detergent, which are put into a washing chamber, together so as to wash the laundry through mutual friction.

The washing machine includes a housing forming an exterior and a detergent supply device provided in the housing. The detergent supply device is a device that allows detergent to be evenly mixed and supplied together with the water in a process in which the water is supplied to a tub of the washing machine.

The detergent supply device may include a detergent box provided to store (or receive) detergent and a detergent pump configured to pump the detergent stored in the detergent box. Detergent stored in the detergent box is supplied into the detergent pump and then discharged to the outside of the detergent pump to move to the washing chamber together with wash water.

The detergent box may be withdrawn from the housing or inserted into the housing to allow a user to put detergent into the detergent box. The washing machine may include an elastic member disposed at one side of the detergent box so that the detergent box is inserted into the housing without an excessive force of a user while the detergent box is being inserted into the housing, and so that the detergent box is docked to the detergent pump.

DISCLOSURE

Technical Problem

The present disclosure is directed to providing a washing machine including a detergent box configured to be easily inserted into a housing.

Further, the present disclosure is directed to providing a washing machine including a detergent box configured to be smoothly inserted into a housing without an interruption.

Technical Solution

One aspect of the present disclosure provides a washing machine including a housing, a tub in the housing, a detergent box configured to move out of the housing in a withdrawal direction and move into the housing in an insertion direction, and including a detergent storage space to store therein a detergent to be supplied to the tub, a first elastic member on a first side of the detergent box, a second elastic member on a second side of the detergent box, wherein the first elastic member and the second elastic member are configured so that, in response to the detergent box being moved into the housing in the insertion direction, the first elastic member presses the detergent box in the insertion direction away from a first position within the housing and the second elastic member presses the detergent box in the insertion direction away from a second position within the housing and where the second position is spaced from the first position, and in response to the detergent box being moved out of the housing in the withdrawal direction, the first elastic member and the second elastic member press the detergent box in the insertion direction.

One aspect of the present disclosure provides that in response to the detergent box is being moved into the housing in the insertion direction, the first elastic member may press the detergent box in the insertion direction from the first position to a third position spaced from the second position in the insertion direction, and the second elastic member may press the detergent box in the insertion direction from the second position to the third position.

One aspect of the present disclosure provides a first fixed bracket on the first side of the detergent box to which a first end of the first elastic member may be fixed; and a second fixed bracket on the second side of the detergent box to which a first end of the second elastic member may be fixed.

One aspect of the present disclosure provides a first guide rail may be formed in the first fixed bracket: a second guide rail may be formed in the second fixed bracket: a first moving bracket may be coupled to the first side of the detergent box and to which a second end of the first elastic member may be fixed, the first moving bracket may be moveable along the first guide rail of the first fixed bracket; and a second moving bracket may be coupled to the second side of the detergent box and to which a second end of the second elastic member may be fixed, the second moving bracket may be moveable along the second guide rail of the second fixed bracket.

One aspect of the present disclosure provides a first guide pin may couple the first moving bracket to the detergent box so that the first moving bracket and the detergent box may be moveable along the first guide rail; and a second guide pin may couple the second moving bracket to the detergent box so that the second moving bracket and the detergent box may be moveable along the second guide rail.

One aspect of the present disclosure provides a first guide hole may be formed in the first fixed bracket so that the first guide pin may be moveable along the first guide hole; and a second guide hole may be formed in the second fixed bracket so that the second guide pin may be moveable along the second guide hole.

One aspect of the present disclosure provides a first fixing hole at a front end of the first guide hole and formed at the first position, the first fixing hole may be configured to fix the first guide pin in response to the detergent box moved in the withdrawal direction from the first position; and a second fixing hole at a front end of the second guide hole and formed at the second position, the second fixing hole may be configured to fix the second guide pin in response to the detergent box moved in the withdrawal direction from the second position.

One aspect of the present disclosure provides the first elastic member may include a plurality of first elastic members, at least one of the plurality of first elastic members may be fixed to an upper portion of the first fixed bracket, and at least one other of the plurality of first elastic members may be fixed to a lower portion of the first fixed bracket, and the second elastic member may include a plurality of second elastic members, at least one of the plurality of second elastic members may be fixed to an upper portion of the second fixed bracket, and at least one other of the plurality of second elastic members may be fixed to a lower portion of the second fixed bracket.

One aspect of the present disclosure provides a detergent pump which may include a detergent suction part, and a sealing member formed in the detergent suction part, and wherein the detergent box may further include: a detergent box hole formed at a rear side of the detergent box, and wherein the detergent box may dock to the detergent pump so that the sealing member seals the detergent box hole and the detergent suction part may be configured to intake detergent stored in the detergent box in response to the detergent box being moved into the housing in the insertion direction.

One aspect of the present disclosure provides the sealing member may include a plurality of sealing members formed in the detergent suction part, and the first elastic member and the second elastic member may press the detergent box so that the plurality of sealing members may be pressed inside the detergent box hole.

One aspect of the present disclosure provides the first elastic member may press the detergent box from the first position to a third position spaced rearward of the second position, the second elastic member may press the detergent box from the second position to the third position, and the third position may be where the detergent box may be docked to the detergent pump.

One aspect of the present disclosure provides the first elastic member and the second elastic member may have different elastic moduli.

One aspect of the present disclosure provides an elastic modulus of the second elastic member may be greater than an elastic modulus of the first elastic member.

One aspect of the present disclosure provides a detergent housing may accommodate the detergent box and to which the first fixed bracket and the second fixed bracket may be coupled.

One aspect of the present disclosure provides the detergent box may be moveable relative to the detergent housing along the insertion direction and the withdrawal direction, and the first fixed bracket may be disposed between the detergent housing and the detergent box along the first side of the detergent box and the second fixed bracket may be disposed between the detergent housing and the detergent box along the second side of the detergent box.

One aspect of the present disclosure provides a washing machine including a housing, a tub disposed within the housing, and a detergent supply device configured to supply detergent to an inside of the tub.

One aspect of the present disclosure provides the detergent supply device may include a detergent box provided to store detergent, and configured to be withdrawn forward from the housing or inserted rearward into the housing, a detergent pump including a detergent suction part disposed at a rear side of the detergent box and extending toward the detergent box to intake the detergent contained in the detergent box in response to the detergent box being docked, and a sealing member formed in the detergent suction part, and an elastic member configured to press the detergent box backward in response to the detergent box being withdrawn from the housing.

One aspect of the present disclosure provides the elastic member may be configured to press the detergent box backward in response to the detergent box being withdrawn from the housing. The elastic member may include a first elastic member disposed on a first side of the detergent box and configured to press the detergent box backward from a first position, and a second elastic member disposed on a second side of the detergent box and configured to press the detergent box from a second position rearwardly spaced from the first position.

One aspect of the present disclosure provides a washing machine including a housing, a tub disposed within the housing, and a detergent box configured to be withdrawn forward from the housing or inserted rearward into the housing.

One aspect of the present disclosure provides the washing machine may further include a first elastic member disposed on a first side of the detergent box and having a first elastic modulus to press the detergent box rearward from a first position while the detergent box is being inserted into the housing, and a second elastic member disposed on a second side of the detergent box and having a second elastic modulus greater than the first elastic modulus so as to press the detergent box rearward from a second position at a rear side of the first position while the detergent box is being inserted into the housing.

One aspect of the present disclosure provides the first elastic member may press the detergent box from the first position to a third position rearwardly spaced apart from the second position, and the second elastic member may press the detergent box from the second position to the third position.

Advantageous Effects

MODES OF THE INVENTION

Figure 1:
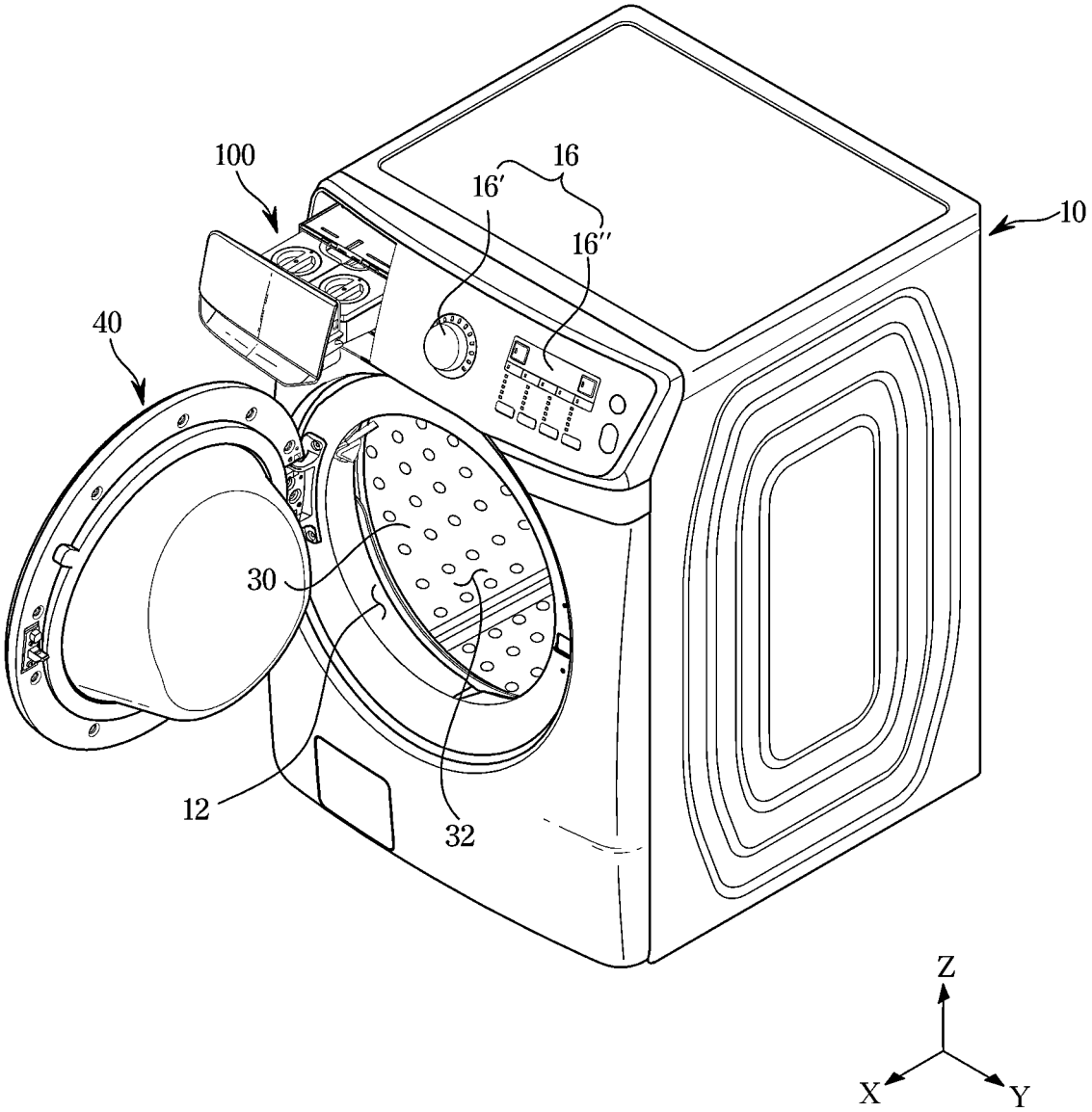
FIG. 1 is a perspective view of a washing machine according to one embodiment.

Various embodiments and the terms used therein are not intended to limit the technology disclosed herein to specific forms, and the disclosure should be understood to include various modifications, equivalents, and/or alternatives to the corresponding embodiments.

In describing the drawings, similar reference numerals may be used to designate similar constituent elements.

A singular expression may include a plural expression unless otherwise indicated herein or clearly contradicted by context.

The expressions "A or B," "at least one of A or/and B," or "one or more of A or/and B," A, B or C," "at least one of A, B or/and C," or "one or more of A, B or/and C," and the like used herein may include any and all combinations of one or more of the associated listed items.

The term of "and/or" includes a plurality of combinations of relevant items or any one item among a plurality of relevant items.

Herein, the expressions "a first", "a second", "the first", "the second", etc., may simply be used to distinguish an element from other elements, but is not limited to another aspect (e.g., importance or order) of elements.

When an element (e.g., a first element) is referred to as being "(functionally or communicatively) coupled," or "connected" to another element (e.g., a second element), the first element may be connected to the second element, directly (e.g., wired), wirelessly, or through a third element.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

When an element is said to be "connected", "coupled", "supported" or "contacted" with another element, this includes not only when elements are directly connected, coupled, supported or contacted, but also when elements are indirectly connected, coupled, supported or contacted through a third element.

Throughout the description, when an element is "on" another element, this includes not only when the element is in contact with the other element, but also when there is another element between the two elements.

A washing machine according to various embodiments may perform washing, rinsing, spin-drying, and drying processes. The washing machine is an example of a clothes care apparatus, and the clothes care apparatus is a concept including a device capable of washing clothes (objects to be washed, and objects to be dried), a device capable of drying clothes, and a device capable of washing and drying clothes.

The washing machine according to various embodiments may include a top-loading washing machine in which a laundry inlet for inserting or withdrawing laundry is provided to face upward, or a front-loading washing machine in which a laundry inlet is provided to face forward. The washing machine according to various embodiments may include a washing machine that is in a loading type other than the top-loading washing machine and the front-loading washing machine.

In the top-loading washing machine, laundry may be washed using water current generated by a rotating body such as a pulsator. In the front-loading washing machine, laundry may be washed by repeatedly lifting and lowering laundry by rotating a drum. The front-loading washing machine may include a dryer combined washing machine capable of drying laundry stored in a drum. The dryer combined washing machine may include a hot air supply device for supplying high-temperature air into the drum and a condensing device for removing moisture from air discharged from the drum. For example, the dryer combined washing machine may include a heat pump device. The washing machine according to various embodiments may include a washing machine using a washing method other than the above-described washing method.

The washing machine according to various embodiments may include a housing accommodating various components therein. The housing may be provided in the form of a box including a laundry inlet on one side thereof.

The washing machine may include a door for opening and closing the laundry inlet. The door may be rotatably mounted to the housing by a hinge. At least a portion of the door may be transparent or translucent to allow the inside of the housing to be seen.

The washing machine may include a tub arranged inside the housing to store water. The tub may be formed in a substantially cylindrical shape with a tub opening formed at one side thereof. The tub may be disposed inside the housing in such a way that the tub opening corresponds to the laundry inlet.

The tub may be connected to the housing by a damper. The damper may absorb vibration generated when the drum rotates, and the damper may reduce vibration transmitted to the housing.

The washing machine may include a drum provided to accommodate laundry.

The drum may be disposed inside the tub in such a way that a drum opening provided at one side of the drum corresponds to the laundry inlet and the tub opening. Laundry may pass through the laundry inlet, the tub opening, and the drum opening, sequentially and then be accommodated in the drum or withdrawn from the drum.

The drum may perform each operation according to washing, rinsing, and/or spin-drying while rotating inside the tub. A plurality of through holes may be formed in a cylindrical wall of the drum to allow water stored in the tub to be introduced into or to be discharged from the drum.

The washing machine may include a driving device configured to rotate the drum. The driving device may include a drive motor and a rotating shaft for transmitting a driving force generated by the drive motor to the drum. The rotating shaft may penetrate the tub to be connected to the drum.

The driving device may perform respective operations according to washing, rinsing, and/or spin-drying, or drying processes by rotating the drum in a forward or reverse direction.

The washing machine may include a water supply device configured to supply water to the tub. The water supply device may include a water supply pipe and a water supply valve disposed in the water supply pipe. The water supply pipe may be connected to an external water supply source. The water supply pipe may extend from an external water supply source to a detergent supply device and/or the tub. Water may be supplied to the tub through the detergent supply device. Alternatively, water may be supplied to the tub without passing through the detergent supply device.

The water supply valve may open or close the water supply pipe in response to an electrical signal of a controller. The water supply valve may allow or block the supply of water to the tub from an external water supply source. The water supply valve may include a solenoid valve configured to open and close in response to an electrical signal.

The washing machine may include the detergent supply device configured to supply detergent to the tub. The detergent supply device may include a manual detergent supply device that requires a user to input detergent to be used for each washing, and an automatic detergent supply device that stores a large amount of detergent and automatically inputs a predetermined amount of detergent during washing. The detergent supply device may include a detergent box for storing detergent. The detergent supply device may be configured to supply detergent into the tub during a water supply process. Water supplied through the water supply pipe may be mixed with detergent via the detergent supply device. Water mixed with detergent may be supplied into the tub. Detergent is used as a term including detergent for pre-washing, detergent for main washing, fabric softener, bleach, etc., and the detergent box may be partitioned into a storage region for the pre-washing detergent, a storage region for the main washing detergent, a storage region for the fabric softener, and a storage region for the bleach.

The washing machine may include a drainage device configured to discharge water contained in the tub to the outside. The drainage device may include a drain pipe extending from a bottom of the tub to the outside of the housing, a drain valve disposed on the drain pipe to open and close the drain pipe, and a pump disposed on the drain pipe. The pump may pump water from the drain pipe to the outside of the housing.

The washing machine may include a control panel disposed on one side of the housing. The control panel may provide a user interface for interaction between a user and the washing machine. The user interface may include at least one input interface and at least one output interface.

The at least one input interface may convert sensory information received from a user into an electrical signal.

The at least one input interface may include a power button, an operation button, a course selection dial (or a course selection button), and a washing/rinsing/spin-drying setting button. The at least one input interface may include a tact switch, a push switch, a slide switch, a toggle switch, a micro switch, a touch switch, a touch pad, a touch screen, a jog dial, and/or a microphone.

The at least one output interface may visually or audibly transmit information related to the operation of the washing machine to a user.

For example, the at least one output interface may transmit information related to a washing course, operation time of the washing machine, and washing/rinsing/spin-drying settings to the user. Information about the operation of the washing machine may be output through a screen, an indicator, or voice. The at least one output interface may include a Liquid Crystal Display (LCD) panel, a Light Emitting Diode (LED) panel, or a speaker.

The washing machine may include a communication module for wired and/or wireless communication with an external device.

The communication module may include at least one of a short-range wireless communication module and a long-range wireless communication module.

The communication module may transmit data to an external device (e.g., a server, a user device, and/or a home appliance) or receive data from the external device. For example, the communication module may establish communication with a server and/or a user device and/or a home appliance, and transmit and receive various types of data.

For the communication, the communication module may establish a direct (e.g., wired) communication channel or a wireless communication channel between external devices, and support the performance of the communication through the established communication channel. According to one embodiment, the communication module may include a wireless communication module (e.g., a cellular communication module, a short-range wireless communication module, or a global navigation satellite system (GNSS) communication module) or a wired communication module (e.g., a local area network (LAN) communication module, or a power line communication module). Among these communication modules, the corresponding communication module may communicate with an external device through a first network (e.g., a short-range wireless communication network such as Bluetooth, wireless fidelity (Wi-Fi) direct, or infrared data association (IrDA)) or a second network (e.g., a long-range wireless communication network such as a legacy cellular network, a 5G network, a next-generation communication network, the Internet, or a computer network (e.g., LAN or WAN). These various types of communication modules may be integrated as one component (e.g., a single chip) or implemented as a plurality of separate components (e.g., multiple chips).

The short-range wireless communication module may include a Bluetooth communication module, a Bluetooth Low Energy (BLE) communication module, a near field communication module, a WLAN (Wi-Fi) communication module, and a Zigbee communication module, an infrared data association (IrDA) communication module, a Wi-Fi Direct (WFD) communication module, an ultrawideband (UWB) communication module, an Ant+ communication module, a microwave (uWave) communication module, etc., but is not limited thereto.

The long-range wireless communication module may include a communication module that performs various types of long-range wireless communication, and may include a mobile communication circuitry. The mobile communication circuitry transmits and receives radio signals with at least one of a base station, an external terminal, and a server on a mobile communication network.

According to one embodiment, the communication module may communicate with an external device such as a server, a user device and other home appliances through an access point (AP). The access point (AP) may connect a local area network (LAN), to which a washing machine or a user device is connected, to a wide area network (WAN) to which a server is connected. The washing machine or the user device may be connected to the server through the wide area network (WAN). The controller may control various components of the washing machine (e.g., the drive motor, and the water supply valve). The controller may control various components of the washing machine to perform at least one operation including water supply, washing, rinsing, and/or spin-drying according to a user input. For F example, the controller may control the drive motor to adjust the rotational speed of the drum or control the water supply valve of the water supply device to supply water to the tub.

The controller may include hardware such as a CPU or memory, and software such as a control program. For example, the controller may include at least one memory for storing an algorithm and program-type data for controlling the operation of components in the washing machine, and at least one processor configured to perform the above-mentioned operation by using the data stored in the at least one memory. The memory and the processor may each be implemented as separate chips. The processor may include one or more processor chips or may include one or more processing cores. The memory may include one or more memory chips or one or more memory blocks. Alternatively, the memory and the processor may be implemented as a single chip.

Meanwhile, the terms "front", "rear", "left" and "right" used in the following description are defined based on the drawings, and the shape and location of each component are not limited by these terms.

In addition, although the present disclosure is described based on a front-loading washing machine, the washing machine according to various embodiments may also be applied to a top-loading washing machine in which a laundry inlet for inserting or withdrawing laundry is provided to face upward.

Hereinafter embodiments according to the present disclosure will be described in detail with reference to the accompanying drawings.

Figure 2:
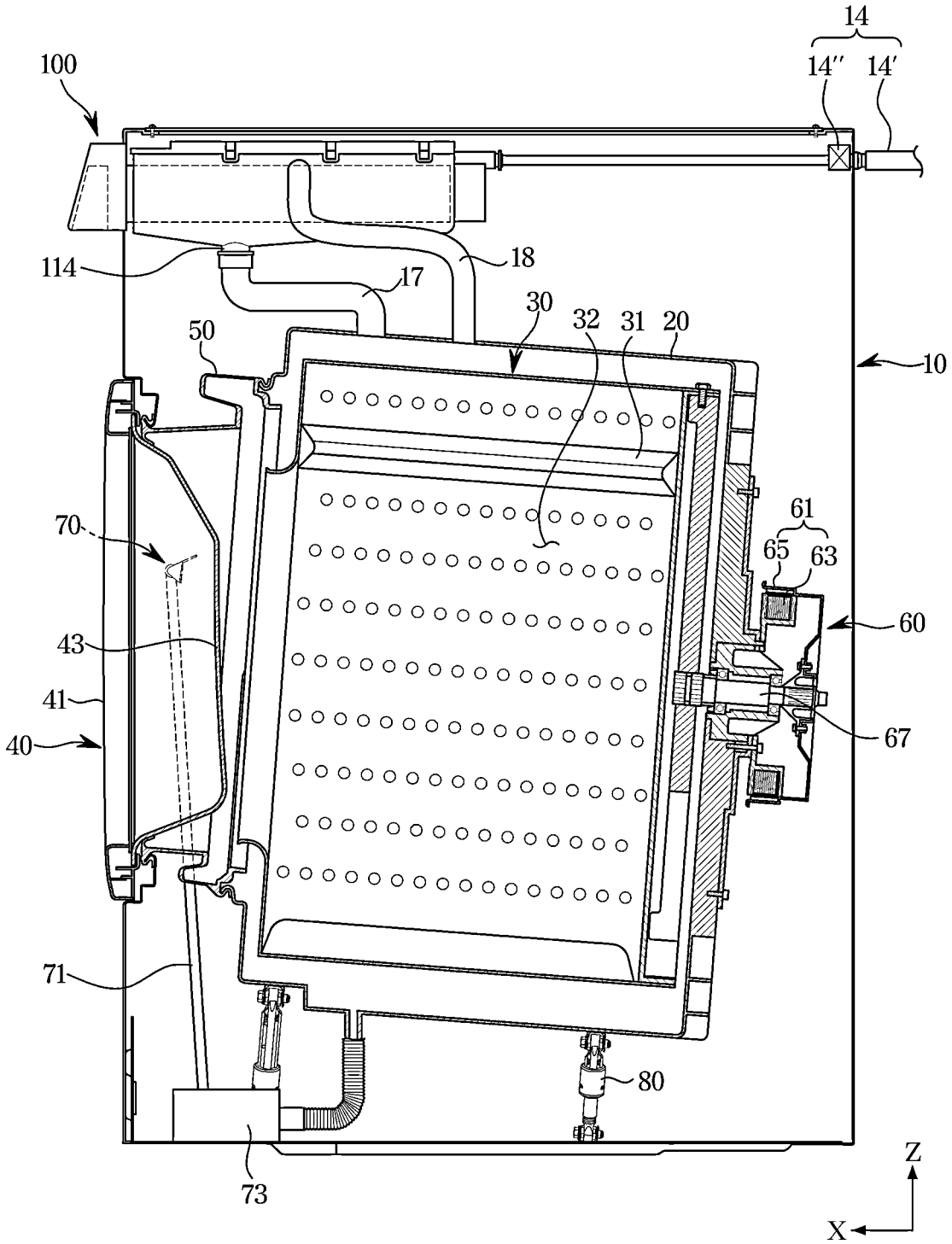
FIG. 2 is a side view of the washing machine according to one embodiment.

FIG. 1 is a perspective view of a washing machine according to one embodiment. FIG. 1 is a perspective view illustrating a state in which a door 40 of the washing machine 1 is open and a detergent box 200 is withdrawn. FIG. 2 is a side view of the washing machine according to one embodiment.

Referring to FIG. 1, the washing machine 1 refers to a device that uses a driving force of a motor 61 to agitate laundry, wash water, and detergent, which are put into a washing chamber 32, together so as to wash the laundry through mutual friction. Laundry may include clothes. When the laundry is clothes, the washing machine 1 may be referred to as a clothes treating apparatus.

The washing machine 1 may be classified into a drum washing machine that washes laundry by repeatedly lifting and lowering the laundry by rotating a drum 30, and an electric washing machine that washes laundry using water current generated by a pulsator.

Alternatively, the washing machine 1 may be classified according to a direction in which laundry is put into the washing chamber 32. The washing machine 1 may be classified into a front-loading washing machine 1 that accommodates laundry to the washing chamber 32 from the front, and a top-down loading washing machine 1 that accommodates laundry to the washing chamber 32 from the top.

It is illustrated that the washing machine 1 of FIG. 1 is a drum washing machine and a front-loading washing machine, but is not limited thereto. Accordingly, the present disclosure may be applied to other types of washing machines.

As illustrated in FIG. 1, the washing machine 1 may include a housing 10 forming an exterior of the washing machine and accommodating various components therein. The housing 10 may be formed in a substantially hexahedral shape.

A control panel 16 including an inputter 16' configured to receive operation commands from a user and a display 16" configured to display operation information of the washing machine 1 may be provided on a front surface of the housing 10. The control panel 16 may provide a user interface 16 for interaction between a user and the washing machine. The user interface 16 may include at least one input interface and at least one output interface. For example, the inputter 16' may be an input interface 16', and the display 16" may be an output interface 16".

A laundry inlet 12 provided to put laundry into the drum 30 may be formed in a front portion of the housing 10. The laundry inlet 12 formed in the front portion of the housing 10 may be opened and closed by the door 40. The door 40 may be rotatably mounted to the front portion of the housing 10 by a hinge member (not shown).

The washing machine 1 may include a detergent supply device 100. The detergent supply device 100 is a device configured to supply detergent to the inside of the tub 20 of the washing machine 1. It is illustrated that the detergent supply device 100 is disposed on an upper right side of the washing machine 1 in FIG. 1, but is not limited thereto.

Referring to FIG. 2, the washing machine 1 may include a tub 20 arranged inside the housing 10 forming an appearance of the washing machine 1 and configured to store mixed water in which water and detergent are mixed. The drum 30 forming the washing chamber 32 to accommodate laundry may be provided inside the tub 20. In other words, it can be said that the drum 30 is provided inside the housing 10 and forms the washing chamber 32 therein.

A tub opening and a drum opening may be formed in the tub 20 and the drum 30 to allow laundry to be inserted into or withdrawn from a front side of the housing 10. The openings of the tub 20 and the drum 30 may be disposed to correspond to the laundry inlet 12 arranged on the front surface of the housing 10.

The laundry inlet 12 provided in the front portion of the housing 10 may be opened and closed by the door 40. The door 40 may include a door frame 41 and a door glass 42. The door glass 42 may be formed of a transparent tempered glass material so as to allow a user to see through the inside of the housing 10.

A water supply device 14 including a water supply pipe 14', and a water supply valve 14" configured to control water supply may be provided above the tub 20. In addition, the detergent supply device 100 configured to supply detergent to the inside of the tub 20 during a water supply process may be installed in a front upper portion of the tub 20.

The detergent supply device 100 may be connected to the tub 20 through a supply pipe 17. Water supplied through the water supply pipe 14' may be mixed with detergent via the detergent supply device 100, and mixed water in which water and detergent are mixed may be supplied into the tub 20. When the detergent is liquid detergent, the water supply pipe 14' may supply water directly into the tub 20 through a separate control valve (not shown), and the liquid detergent may be supplied to the inside of the tub 20 from the detergent supply device 100 through a detergent supply pipe (not shown).

The detergent supply device 100 may be connected to the tub 20 through an air pipe 18. The air pipe 18 may be provided to allow air to flow in and/or out of the detergent supply device 100. Accordingly, the air pipe 18 may prevent the pressure inside the detergent supply device 100 from being lowered.

A driving device may be provided on a rear side of the drum 30. The driving device is a component for rotating the drum 30 and may be configured to rotate the drum 30 by transmitting a driving force generated by the drive motor 61 to a rotating shaft 67.

The drive motor 61 may include a fixed stator 63 and a rotor 65 configured to rotate by electromagnetically interacting with the stator 63, and the drive motor 61 may be configured to convert electrical power into a mechanical rotational force.

The tub 20 may store the mixed water in which water and detergent are mixed, and may be formed in a substantially cylindrical shape. The tub 20 may be fixed to the inside of the housing 10. The laundry inlet 12 formed on the front surface of the housing 10 and the tub 20 may be connected by a diaphragm 50.

A spray nozzle 70 configured to spray the mixed water to the inside of the drum 30 by being connected to a circulation hose 71 may be disposed on one side of the diaphragm 50. The spray nozzle 70 may be provided to evenly spray the mixed water to the entire laundry accommodated in the drum 30. The circulation hose 71 may be connected to a circulation pump configured to pump the mixed water stored in the lower portion of the tub 20.

The drum 30 may rotate inside the tub 20 to lift and lower laundry to perform washing. A plurality of lifters 31 may be provided inside the drum 30.

A drain device (not shown) including a drain pipe (not shown) and a drain valve (not shown) for draining water inside the tub 20 may be installed under the tub 20.

The tub 20 may be provided to be elastically supported from the housing 10 by an upper spring (not shown) and lower dampers 80. That is, when vibration caused by the rotation of the drum 30 is transmitted to the tub 20 and the housing 10, the spring and dampers 80 may absorb vibration energy between the tub 20 and the housing 10, thereby reducing the vibration.

Figure 3:
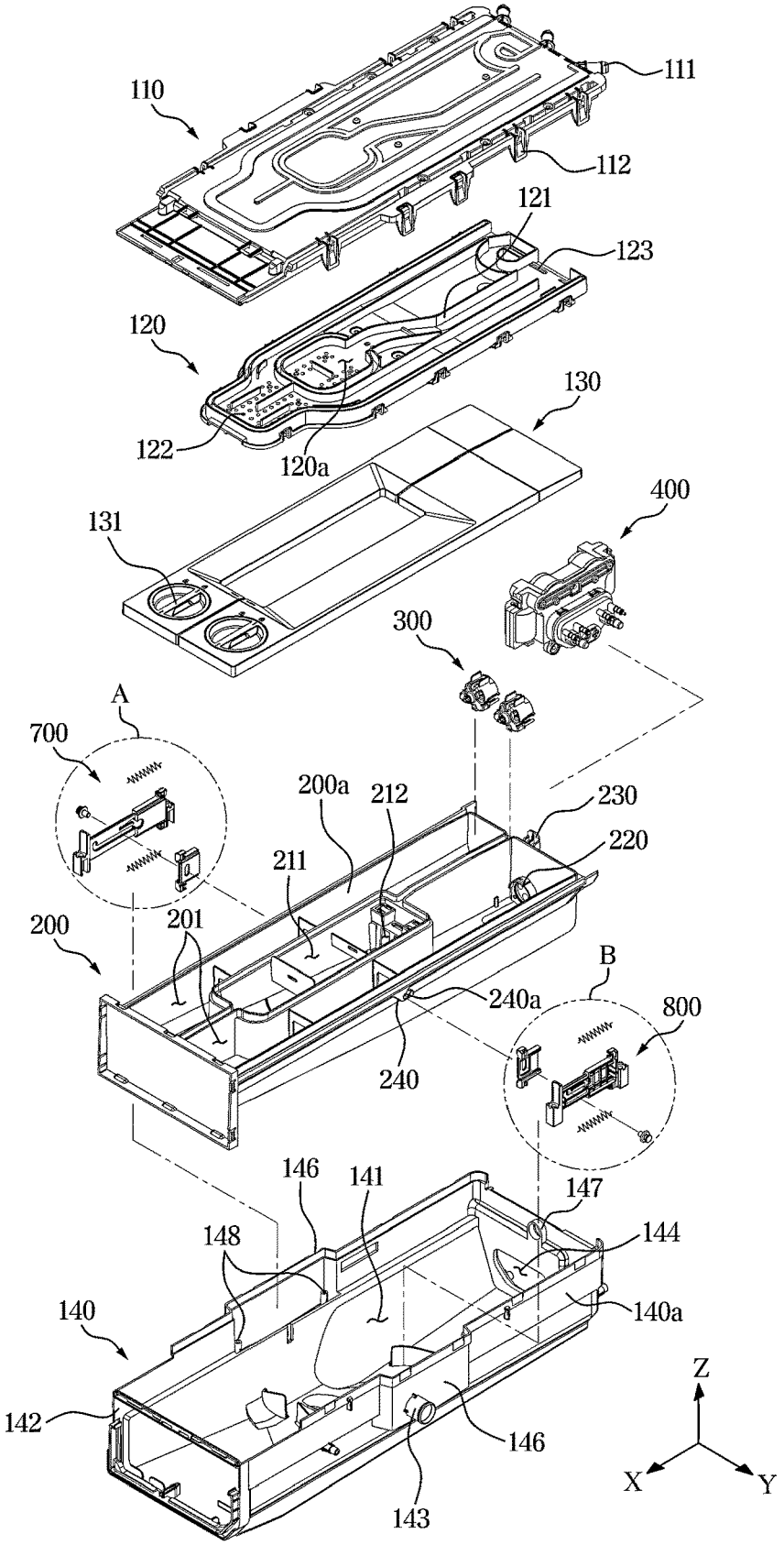
FIG. 3 is an exploded perspective view of a detergent supply device included in the washing machine according to one embodiment.
Figure 4:
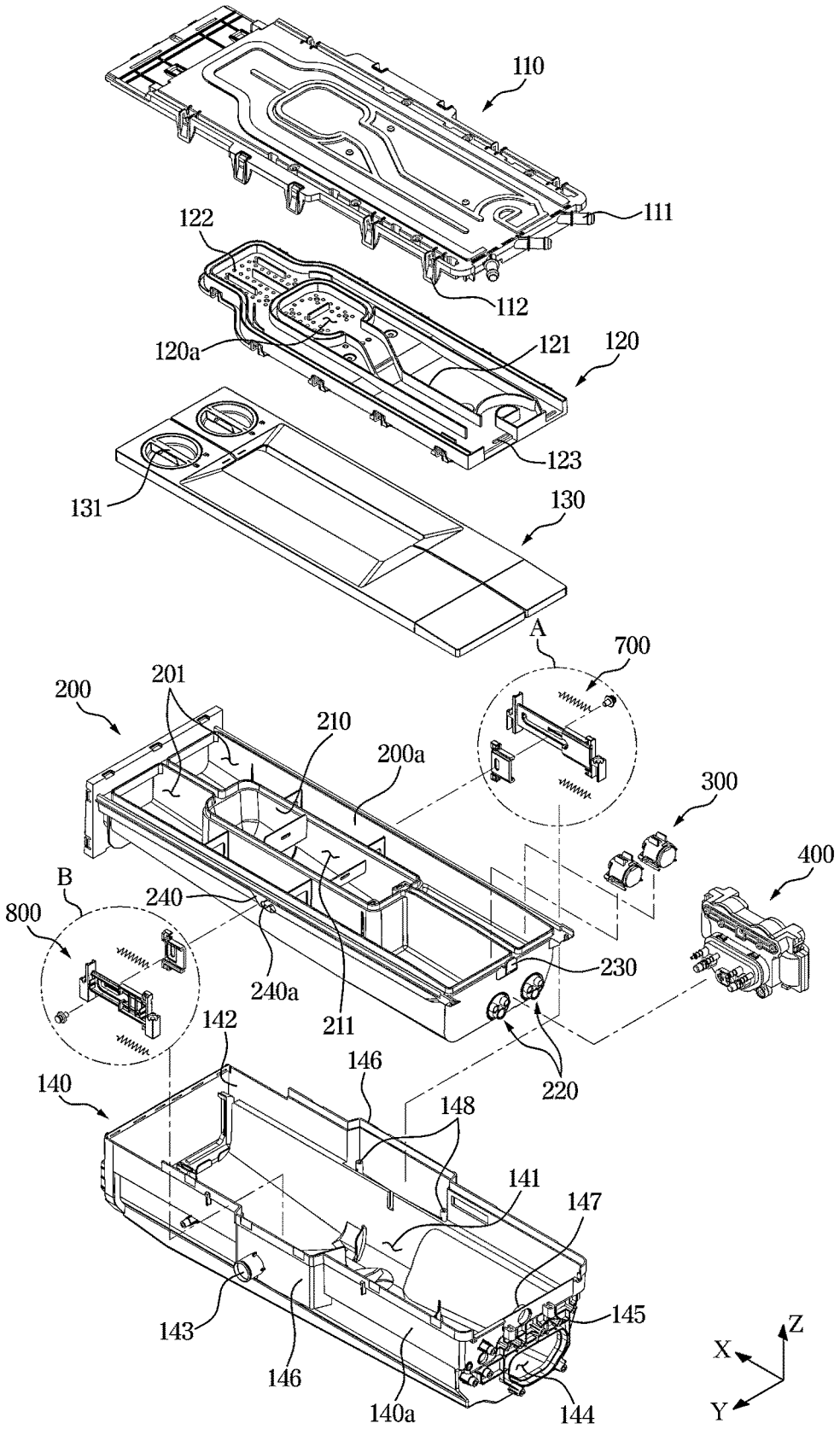
FIG. 4 is an exploded perspective view of the detergent supply device included in the washing machine according to one embodiment.

FIG. 3 is an exploded perspective view of a detergent supply device included in the washing machine according to one embodiment. FIG. 4 is an exploded perspective view of the detergent supply device included in the washing machine according to one embodiment. FIG. 3 illustrates the disassembled detergent supply device when viewed from the front side. FIG. 4 illustrates the disassembled detergent supply device when viewed from the rear side.

Referring to FIGS. 3 and 4, the detergent supply device 100 may include a cover 110. The cover 110 may form the exterior of the detergent supply device 100 together with a detergent housing 140. The cover 110 may be coupled to an upper portion of a water supply plate 120 to seal the water supply plate 120. In other words, the cover 110 may be coupled to the water supply plate 120 to form a flow path through which wash water supplied from the water supply device 14 flows.

The cover 110 may include a wash water inlet 111 connected to the water supply device 14. Wash water may flow into the detergent supply device 100 through the wash water inlet 111.

The detergent supply device 100 may further include the water supply plate 120 coupled to the cover 110 so as to be positioned between the cover 110 and the detergent housing 140. The water supply plate 120 may include a guide partition wall 121 provided to define a flow path 120*a* to allow wash water to flow. The water supply plate 120 together with the cover 110 may form a flow path through which wash water supplied from the water supply device 14 moves.

The water supply plate 120 may include a wash water moving hole 122 provided to discharge wash water, which is supplied from the water supply device 14 to a space between the cover 110 and the water supply plate 120, to a water supply chamber 211. The wash water moving hole 122 may be formed to penetrate the water supply plate 120. The wash water moving hole 122 may be formed in one region of the water supply plate 120 to correspond to the water supply chamber 211. In other words, the wash water moving hole 122 may be formed in one region of the water supply plate 120 facing the water supply chamber 211.

The water supply plate 120 may include a through hole 123 provided to allow a portion of the wash water supplied from the water supply device 14 to pass through so as to prevent detergent, which is discharged from a detergent pump 400 into a mixing chamber 141, from remaining in the mixing chamber 141. The through hole 123 may be located upstream of the wash water moving hole 122 with respect to a direction in which wash water supplied from the water supply device 14 flows. In other words, in the water supply plate 120, the through hole 123 may be formed adjacent to the wash water inlet 111. A portion of the wash water supplied from the water supply device 14 may be discharged to the water supply chamber 211 through the wash water moving hole 122, and the remaining portion may be discharged to the mixing chamber 141 through the through hole 123.

The detergent supply device 100 may further include the detergent housing 140 forming the exterior of the detergent supply device 100 together with the cover 110. The detergent housing 140 may be coupled to the detergent box 200 to allow the detergent box 200 to be withdrawn.

A discharge port (not shown) may be formed on a lower portion of the detergent housing 140 to allow at least one of wash water and detergent to be discharged to the outside of the detergent supply device 100. The discharge port is connected to the supply pipe 17, and at least one of wash water and detergent discharged through the discharge port is moved into the tub 20 through the supply pipe 17. The lower portion of the detergent housing 140 may be inclined toward the discharge port to allow at least one of wash water and detergent to be smoothly discharged through the discharge port without being accumulated on the lower portion of the detergent housing 140.

The detergent housing 140 may include an entrance opening 142. The entrance opening 142 may be formed at one end of the detergent housing 140 to allow the detergent box 200 to be withdrawn therefrom and inserted therein. For example, the entrance opening 142 may be formed at a front end of the detergent housing 140. The entrance opening 142 may be a front opening 142.

The detergent housing 140 may include a step portion 146. The stepped portion 146 may be formed on opposite sides of the detergent housing 140. For example, the stepped portion 146 may protrude outward of the detergent housing 140 from a wall 140*a* of the detergent housing 140. The stepped portion 146 may allow elastic member assemblies 700 and 800 to be accommodated inside the detergent housing 140 and between the detergent housing 140 and the detergent box 200. The stepped portion 146 may be formed in accordance with the number and shape of the elastic member assemblies 700 and 800.

The detergent housing 140 may include a fixing part 148. The fixing part 148 may be provided inside the stepped portion 146. The fixing part 148 may be formed adjacent to the side wall 140*a* of the detergent housing 140. The fixing part 148 may protrude upward. The fixing part 148 may allow the elastic member assemblies 700 and 800 to be fixed and/or fastened to the detergent housing 140.

The detergent housing 140 may include a support 147. The support 147 may be formed at a rear end of the detergent housing 140. The support 147 may protrude toward the inside of the detergent housing 140. The support 147 of the detergent housing 140 may come into contact with the support 230 of the detergent box 200 when the detergent box 200 is completely inserted into the detergent housing 140 (e.g., a third position).

The detergent supply device 100 may include the detergent box 200 forming a detergent storage space 201 in which detergent is stored.

The detergent box 200 may be movably mounted on the detergent housing 140. Liquid detergent may be stored in the detergent box 200. For example, the liquid detergent may include fabric conditioner, fabric softener, and the like.

The detergent box 200 may include a support 230. The support 230 may be formed at the rear end of the detergent box 200. The support 147 of the detergent housing 140 may protrude toward the rear of the detergent box 200. The support 230 of the detergent box 200 may come into contact with the support 147 of the detergent housing 140 when the detergent box 200 is completely inserted into the detergent housing 140 (e.g., the third position).

The detergent supply device 100 may include the elastic member assemblies 700 and 800. The elastic member assemblies 700 and 800 may be coupled to the detergent housing 140. The elastic member assemblies 700 and 800 may be accommodated in the detergent housing 140. For example, the elastic member assemblies 700 and 800 may be disposed inside the stepped portion 146 of the detergent housing 140. The elastic member assemblies 700 and 800 may be disposed between the detergent housing 140 and the detergent box 200. For example, the elastic member assemblies 700 and 800 may be disposed between the left and right direction of the detergent housing 140 and the detergent box 200.

The elastic member assemblies 700 and 800 may include a first elastic member assembly 700 and a second elastic member assembly 800. The first elastic member assembly 700 may be referred to as a first assembly 700 and the second elastic member assembly 800 may be referred to as a second assembly 800. The first elastic member assembly 700 may be composed of only the first elastic member. The second elastic member assembly 800 may be composed of only the second elastic member.

A detergent box cover 130 may be disposed above the detergent box 200 to cover the detergent box 200. The detergent box cover 130 may be formed to correspond to an upper shape of the detergent box 200. However, the detergent box cover 130 may not be formed at a position corresponding to the wash water moving hole 122 of the water supply plate 120 to allow wash water to move.

A detergent box cap 131 may be provided in front of the detergent box cover 130 to allow detergent to be input into the detergent storage space 201. The detergent box cap 131 may be detachably coupled to the detergent box cover 130.

The detergent supply device 100 may further include the water supply chamber 211 formed in the detergent box 200 to allow wash water passing through the wash water moving hole 122 to be introduced therein. The water supply chamber 211 may be formed by a water supply chamber frame 210 of the detergent box 200. Wash water passing through the wash water moving hole 122 may be directly introduced into the water supply chamber 211. Wash water supplied between the cover 110 and the water supply plate 120 may easily pass through the wash water moving hole 122 by gravity, and flow into the water supply chamber 211.

Detergent in the form of solid powder may be input to the water supply chamber 211 in some cases. When detergent in the form of solid powder is input into the water supply chamber 211, the detergent in the form of powder may move into the mixing chamber 141 together with the wash water introduced through the wash water moving hole 122. A communication hole 212 may be formed in the detergent box 200. The communication hole 212 may allow the water supply chamber 211 and the mixing chamber 141 to communicate with each other.

The detergent supply device 100 may further include the mixing chamber 141 provided to allow at least one of wash water discharged from the water supply chamber 211 and detergent discharged from the detergent box 200 to pass through and to be supplied to the tub 20. The mixing chamber 141 may be formed between the detergent box 200 and the detergent housing 140. The mixing chamber 141 may be an accommodating space 141 of the detergent housing 140 accommodating the detergent box 200.

The detergent supply device 100 may include the detergent pump 400 configured to intake detergent from the detergent box 200 and discharge the detergent to the mixing chamber 141.

Figure 5:
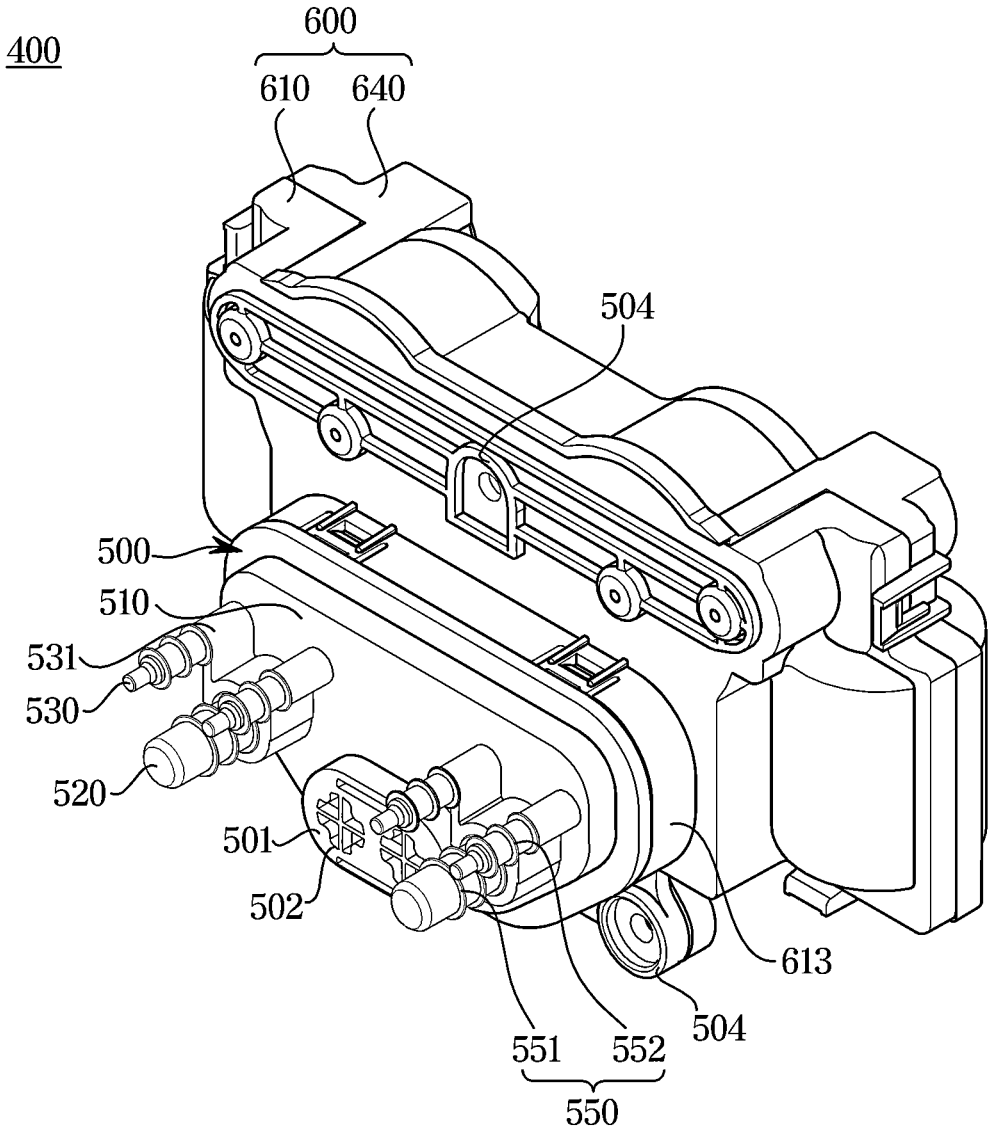
FIG. 5 is a perspective view of a detergent pump included in the washing machine according to one embodiment.

FIG. 5 is a perspective view of a detergent pump included in the washing machine according to one embodiment.

Referring to FIG. 5, the detergent pump 400 may include cases 500 and 600 forming the exterior.

The cases 500 and 600 may include a front case 500 forming a front exterior and a rear case 600 coupled to the rear of the front case 500. For convenience of manufacturing, the rear case 600 may include a middle case 610 coupled to the front case 500 at the rear of the front case 500, and a case cover 640 coupled to the middle case 610 at the rear of the middle case 610.

The front case 500, the middle case 610, and the case cover 640 included in the case may be symmetrical. For example, the detergent box cap 131 provided to input detergent into the detergent box 200 may be formed in pairs on the left and right sides, and thus the cases 500 and 600 including corresponding configurations may be formed symmetrically on the left and right sides.

Further, all configurations described below may be formed symmetrically on the left and right sides with respect to a central portion of the detergent pump 400.

The front case 500 may include a front case body 510. The front case 500 may include a detergent suction part 520 extending from the front case body 510 toward a direction, in which the detergent pump 400 is coupled to the detergent box 200, and including a suction space 521 formed therein. In other words, the detergent suction part 520 may extend forward, and the suction space 521 may be formed inside the detergent suction part 520.

The front case 500 may include a detergent discharge part (not shown) extending forward from the front case body 510 and forming a discharge space therein.

A detergent outlet cap 501 may be provided in front of the detergent discharge part to protect the detergent discharge part. A detergent outlet opening 502 may be provided in front of the detergent outlet cap 501 to allow detergent to be discharged.

The detergent suction part 520 may be directly inserted into the detergent storage space 201. In other words, the detergent suction part 520 may extend forward and be disposed inside the detergent storage space 201 so as to allow the detergent pump 400 to intake detergent located in the detergent storage space 201 into the detergent pump 400.

The detergent suction part 520 may directly press a detergent box valve 320 in a detergent box valve module 300 to be described later. At the same time, the detergent suction part 520 may allow a detergent inlet 522, through which the detergent flows, to be disposed inside the detergent box 200. Accordingly, it is possible to control the inflow of detergent into the detergent pump 400 with a simple configuration (refer to FIGS. 6 and 7).

When the detergent suction part 520 presses the detergent box valve 320, the front of the detergent suction part 520 may press the detergent box valve 320. Accordingly, it is appropriate that the detergent inlet 522 of the detergent suction part 520 is formed on a lateral side of the detergent suction part 520.

Further, due to this configuration, it is possible to exclude a configuration configured to allow detergent to flow to the outside of the detergent box 200 and then to flow again to the detergent pump 400. Accordingly, it is possible to prevent the leakage of the detergent when the detergent pump 400 is undocked from the detergent box 200.

A sensing member 530 configured to measure an amount of detergent remaining in the detergent storage space 201 may be provided adjacent to the detergent suction part 520. When the detergent pump 400 is coupled to the detergent box 200, the sensing member 530 may be in contact with the detergent within the detergent storage space 201, thereby measuring the amount of detergent. Accordingly, the sensing member 530 may be inserted into the detergent storage space 201.

In other words, the detergent pump 400 may include the sensing member 530 protruding or extending toward the front and positioned inside the detergent storage space 201 so as to detect the amount of detergent located in the detergent storage space 201.

In order to enhance strength, the middle case 610 may include a support rib 504 provided above a case opening frame 613.

The support rib 504 may include a shape formed in a position and a shape corresponding to a position and a shape of the support protrusion 145 (refer to FIG. 4) formed at the rear of the detergent housing 140. When an impact is applied to the detergent pump 400, the impact may be dispersed by the support rib 504 and the support protrusion 145.

Figure 6:
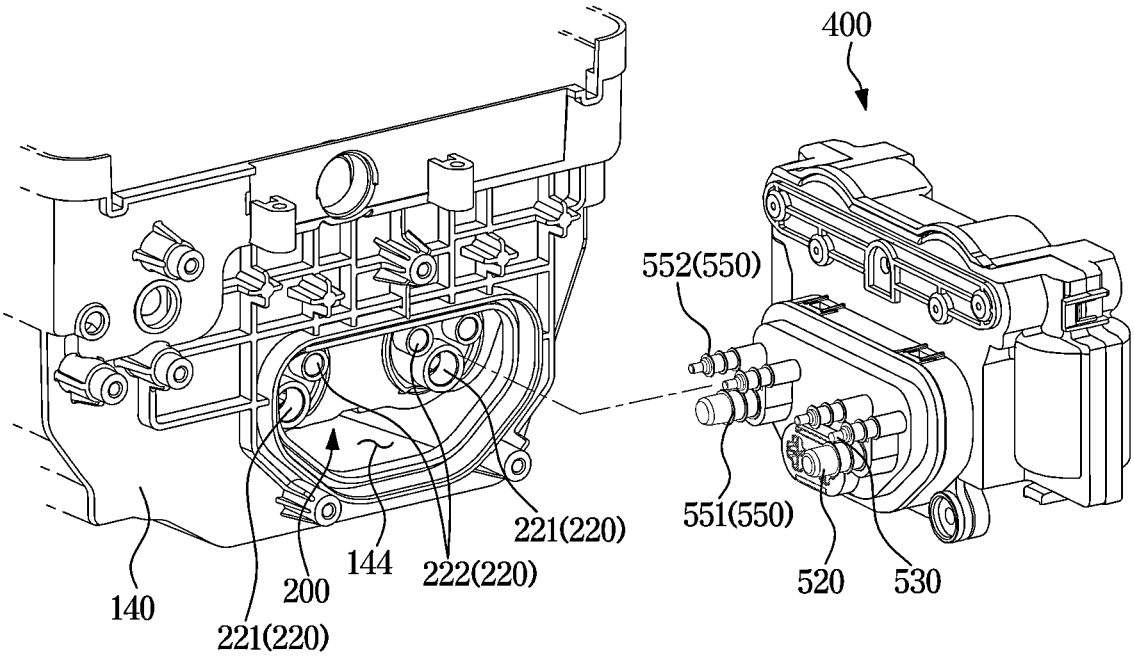
FIG. 6 is a perspective view illustrating a docking relationship between a detergent box and the detergent pump in the washing machine according to one embodiment.

FIG. 6 is a perspective view illustrating a docking relationship between a detergent box and a detergent pump in the washing machine according to one embodiment.

Referring to FIG. 6, the detergent pump 400 may be coupled to the detergent box 200.

The detergent box 200 may be located inside the detergent housing 140. A pump opening 144 formed to correspond to the shape of the front case 500 of the detergent pump 400 may be formed at the rear of the detergent housing 140.

The sensing member 530 protruding forward and the detergent suction part 520 protruding forward may be formed in the front portion of the detergent pump 400.

The detergent pump 400 may include a first sealing member 551 provided to surround the detergent suction part 520 and a second sealing member 552 provided to surround the sensing member 530. The first sealing member 551 and the second sealing member 552 may be provided in plurality. Each of the plurality of first sealing members 551 and the plurality of second sealing members 552 may be arranged toward a detergent box hole 220.

A first detergent box hole 221 formed at a position corresponding to the detergent suction part 520 to allow the detergent suction part 520 to be inserted therein may be formed at the rear of the detergent box 200. In addition, a second detergent box hole 222 formed at a position corresponding to the sensing member 530 to allow the sensing member 530 to be inserted therein may be formed at the rear of the detergent box 200.

Hereinafter a process of docking the detergent pump 400 to the detergent box 200 will be described in detail.

Figure 7:
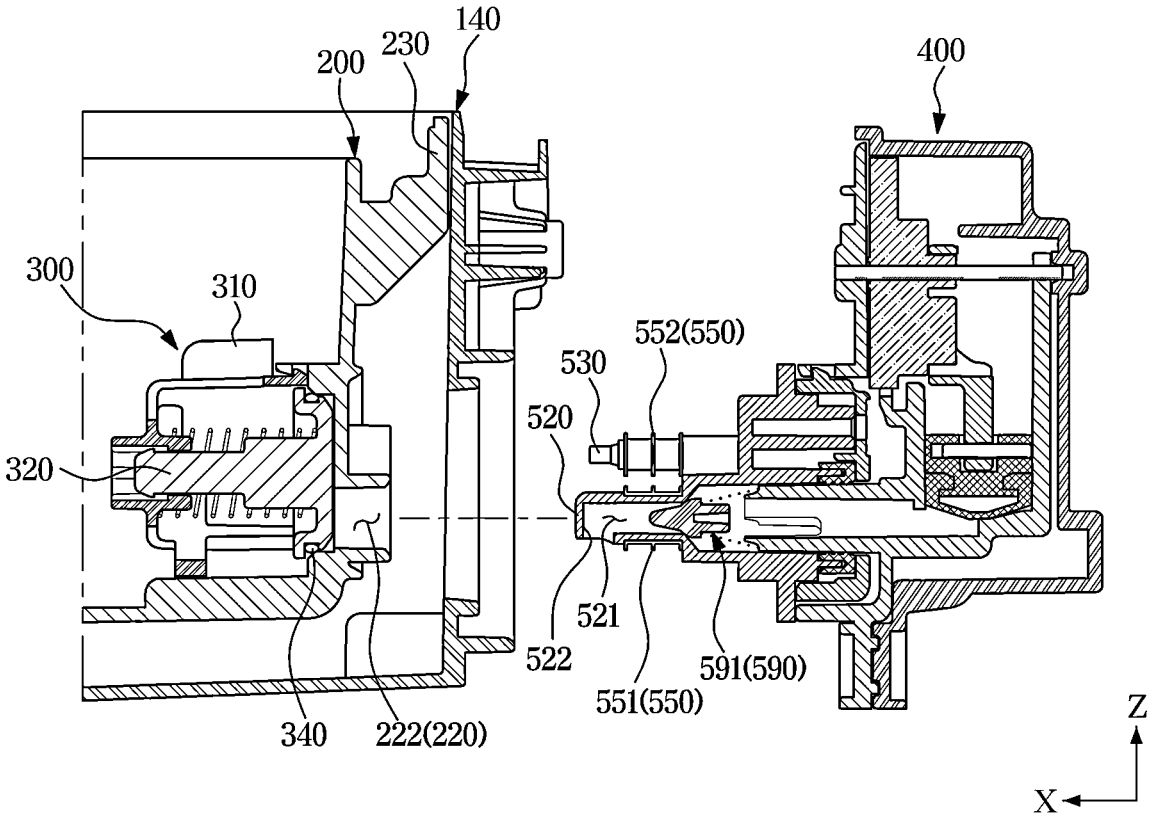
FIG. 7 is a cross-sectional view illustrating a state before the detergent box and the detergent pump of FIG. 6 are docked.
Figure 8:
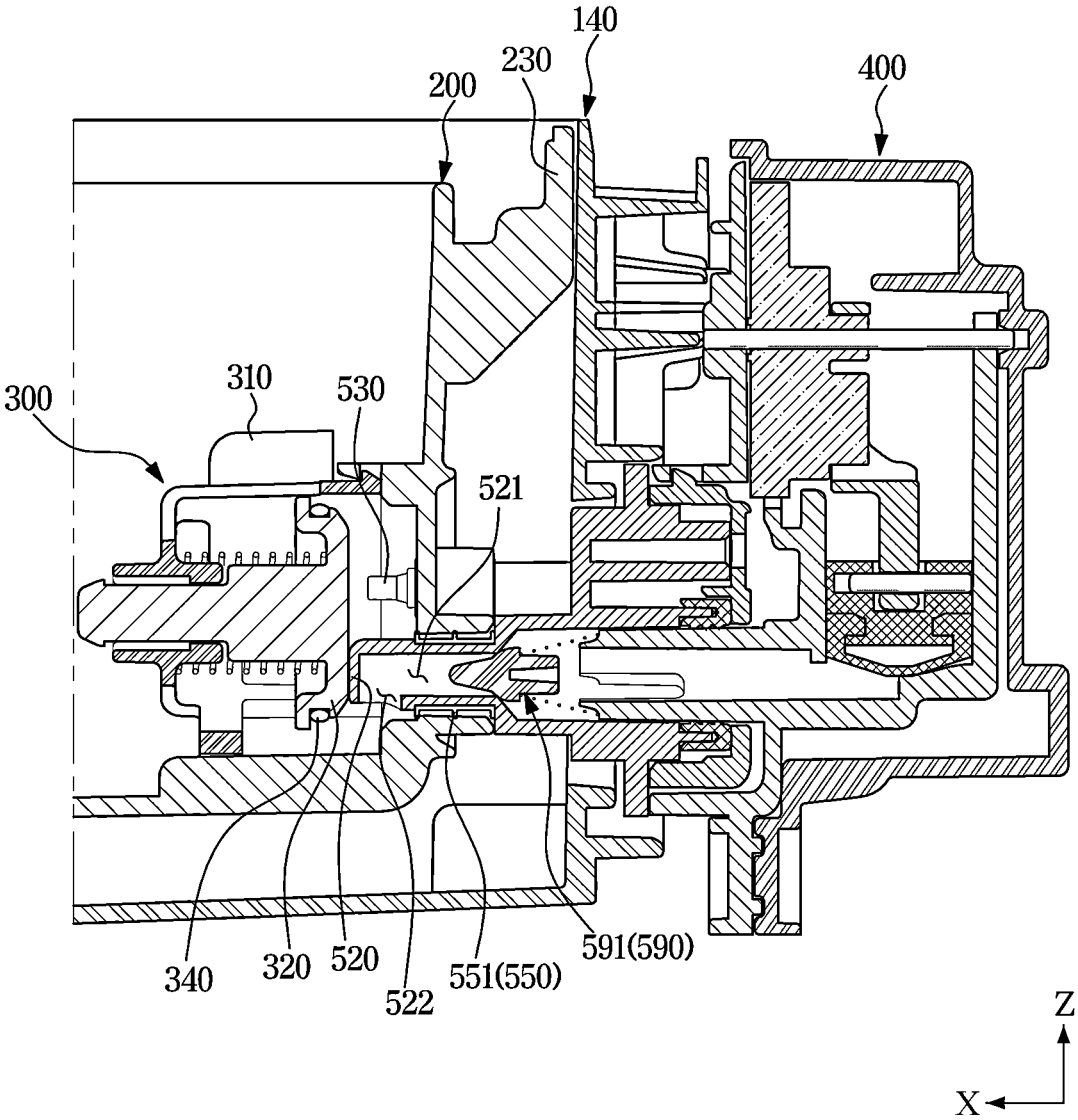
FIG. 8 is a cross-sectional view illustrating a state in which the detergent box and the detergent pump of FIG. 7 are docked.

FIG. 7 is a cross-sectional view illustrating a state before the detergent box and the detergent pump of FIG. 6 are docked. FIG. 8 is a cross-sectional view illustrating a state in which the detergent box and the detergent pump of FIG. 7 are docked.

Referring to FIGS. 7 and 8, the detergent box 200 may move toward the detergent pump 400.

At this time, the detergent suction part 520 may move toward the first detergent box hole 221 and the sensing member 530 may move toward the second detergent box hole 222.

Before the detergent pump 400 is docked to the detergent box 200, the detergent box valve 320 of the detergent box valve module 300 may receive an elastic force in a direction, in which the plurality of detergent box holes 220 is sealed, by a valve elastic member 330. Accordingly, the detergent in the detergent storage space 201 may be not leaked through the plurality of detergent box holes 220.

As illustrated in FIG. 8, when the detergent pump 400 is docked to the detergent box 200, the detergent suction part 520 and the sensing member 530 included in the detergent pump 400 may be inserted into the inside of the detergent box 200.

For example, when the detergent box valve 320 is pressed and moved, the sensing member 530 may be located inside the detergent storage space 201.

At this time, the detergent inlet 522 formed in the detergent suction part 520 may be disposed in the detergent storage space 201 formed inside the detergent box 200. Accordingly, detergent located in the detergent storage space 201 may be introduced into the detergent pump 400 through the detergent inlet 522.

At this time, the sensing member 530 may be located in the detergent storage space 201. The sensing member 530 may measure the amount of detergent by being in contact with the detergent in the detergent storage space 201.

When the detergent suction part 520 presses the detergent box valve 320 forward, the detergent box valve 320 moves forward.

The detergent suction part 520 may be disposed to press the detergent box valve 320 forward to allow the valve sealing member 340 to release the sealing between the plurality of detergent box holes 220 and the detergent box valve 320.

When the detergent pump 400 is docked to the detergent box 200, the detergent suction part 520 presses the detergent box valve 320 to release the sealing between the plurality of detergent box holes 220 and the detergent box valve 320. At the same time, the first sealing member 551 and the second sealing member 552 provided on a first side (e.g., a right side) may seal the first detergent box hole 221 and the second detergent box hole 222 provided on the first side (e.g., the right side), and the first sealing member 511 and the second sealing member 552 provided on a second side (e.g., a left side) may seal the first detergent box hole 221 and the second detergent box hole 222 provided on the second side (e.g., the left side). Accordingly, it is possible to prevent the detergent from being leaked to the outside of the detergent box 200.

It is illustrated that the sealing members 551 and 552 are provided on the detergent suction part 520 and the sensing member 530, but the positions of the sealing members 551 and 552 are not limited thereto. The sealing members 551 and 552 may be provided in various positions as long as the sealing members 551 and 552 are inserted into the detergent box 200 to prevent the leakage of detergent.

When the docking of the detergent pump 400 to the detergent box 200 is completed, detergent may be introduced into the detergent pump 400. Thereafter, the detergent may flow into the detergent suction part 520, flow out through the detergent discharge part, move to the mixing chamber 141 in the detergent housing 140, and flow into the tub 20.

Although not shown, the detergent pump 400 and the detergent box 200 may be undocked. For example, when a user withdraws the detergent box 200 from the housing 10 to put detergent into the detergent box 200, the detergent pump 400 and the detergent box 200 may be undocked.

Figure 9:
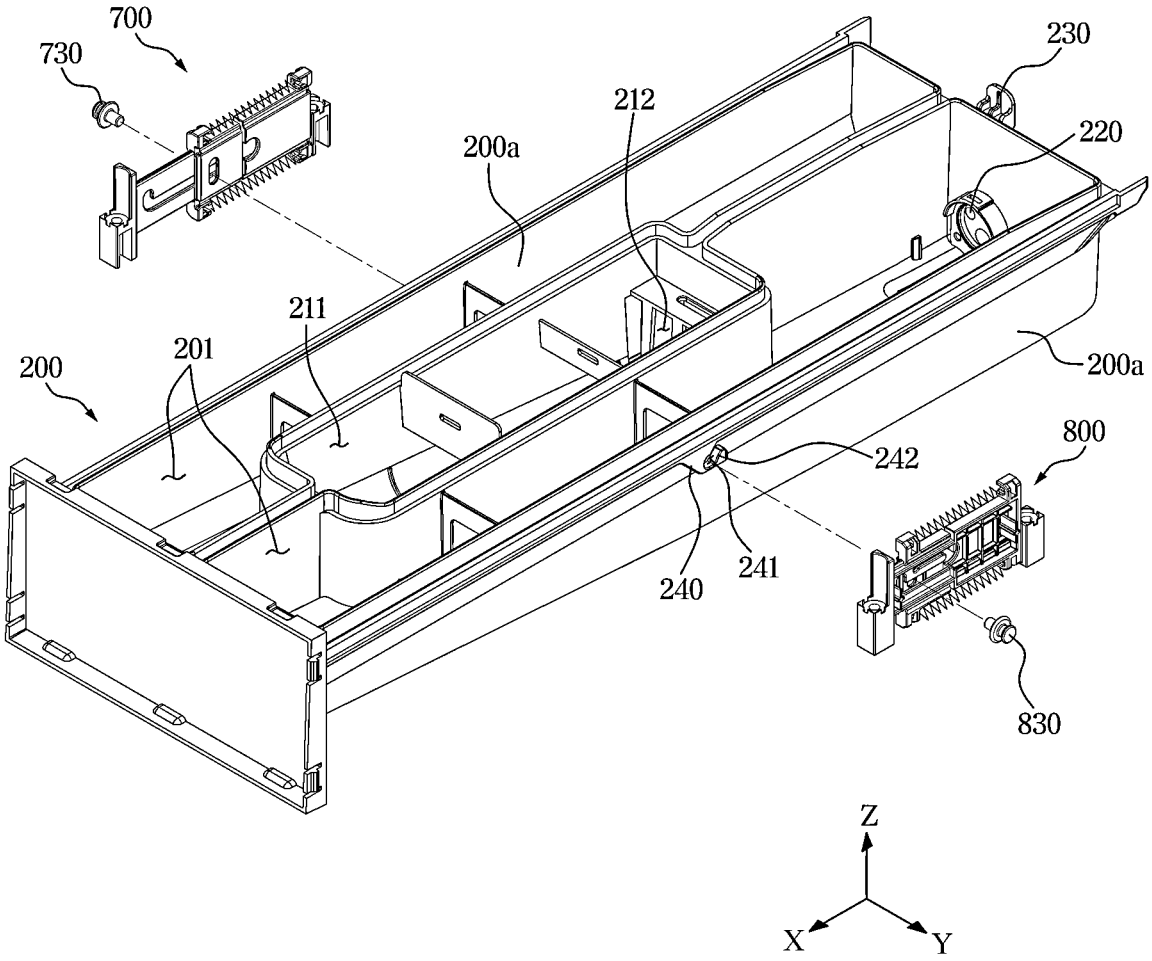
FIG. 9 is an exploded perspective view of some components of the detergent supply device in the washing machine according to one embodiment.

FIG. 9 is an exploded perspective view of some components of the detergent supply device in the washing machine according to one embodiment Referring to FIG. 9, the washing machine according to one embodiment may include the detergent supply device 100, and the detergent supply device 100 may include the detergent box 200, the first assembly 700, and the second assembly 800.

The detergent supply device 100 may include a mounting portion 240 protruding outward from the wall 200*a* of the detergent box 200.

The elastic member assemblies 700 and 800 may be mounted to the mounting portion 240. For example, guide pins 730 and 830 may be inserted into the mounting portion 240 to mount the elastic member assemblies 700 and 800 to the mounting portion 240. The mounting portion 240 may be provided on opposite sides of the detergent box 200, respectively. Accordingly, the first assembly 700 and the second assembly 800 may be respectively mounted on the plurality of mounting portions 240. The plurality of mounting portions 240 may be formed on the first side and the second side of the detergent box 200. For example, the first side may be the right side of the detergent box 200, and the second side may be the left side of the detergent box 200. However, the first side and the second side are not limited to the above examples.

A mounting hole 241 and a mounting guide 242 may be formed in the mounting portion 240. For example, guide pins 730 and 830 to be described later may be mounted to the mounting hole 241. The mounting guide 242 may guide movement of the guide pins 730 and 830 to allow the guide pins 730 and 830 to be separated from the mounting hole 241 while the detergent box 200 is being withdrawn from the housing 10, and to allow the guide pins 730 and 830 to be inserted into the mounting hole 241 while the detergent box 200 is being inserted into the housing 10. The mounting guide 242 may be formed to be inclined upward.

The first assembly 700 and the second assembly 800 may be mounted on the mounting portion 240. For example, on the first side of the detergent box 200, the first assembly 700 may be coupled to the mounting portion 240 formed on the first side of the detergent box 200. On the second side of the detergent box 200, the second assembly 800 may be coupled to the mounting portion 240 formed on the second side of the detergent box 200. The first assembly 700, the detergent box 200, and the second assembly 800 may be arranged in a left and right direction.

Figure 10:
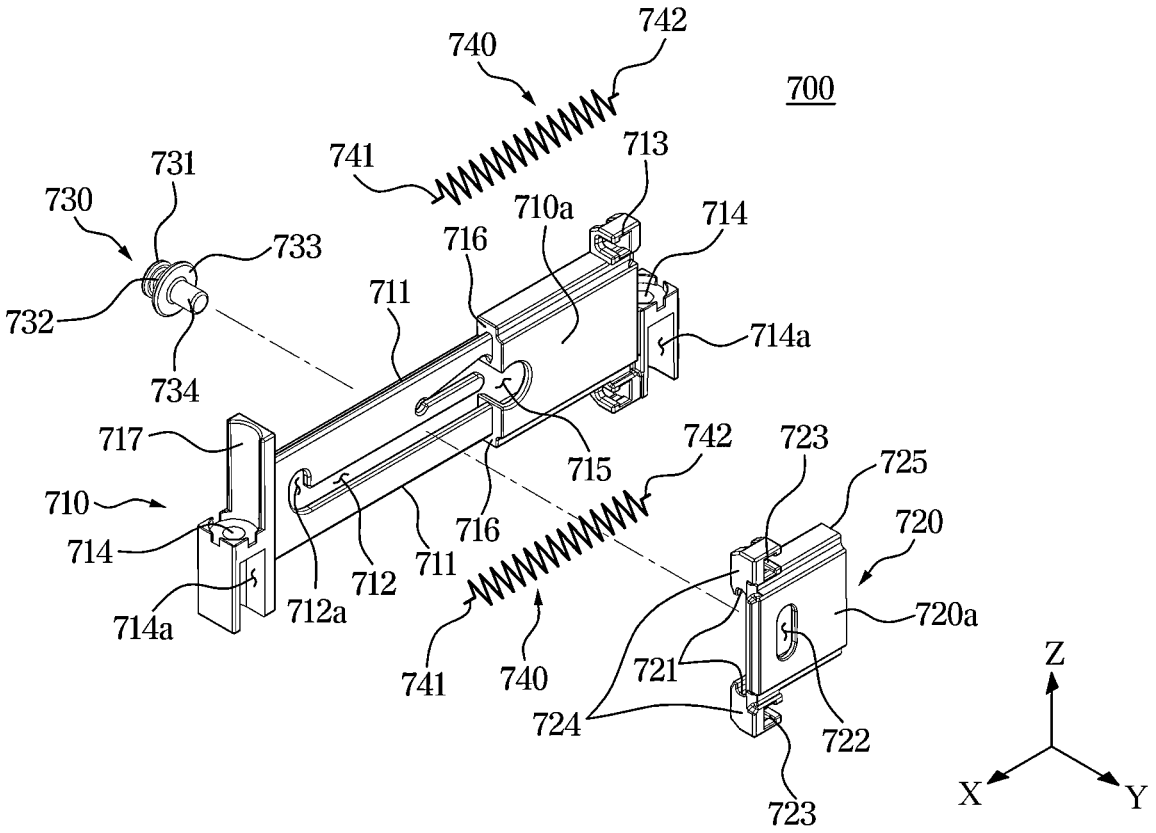
FIG. 10 is an enlarged view of the detergent supply device shown in FIGS. 3 and 4.
Figure 11:
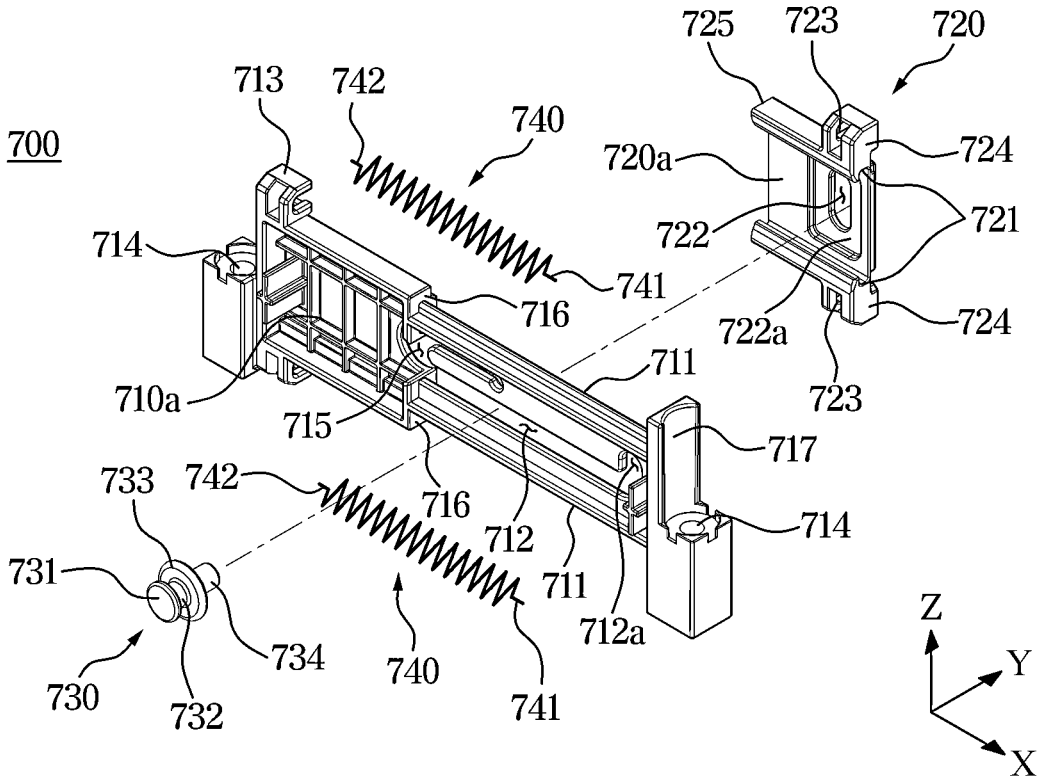
FIG. 11 is an enlarged view of the detergent supply device shown in FIGS. 3 and 4.
Figure 12:
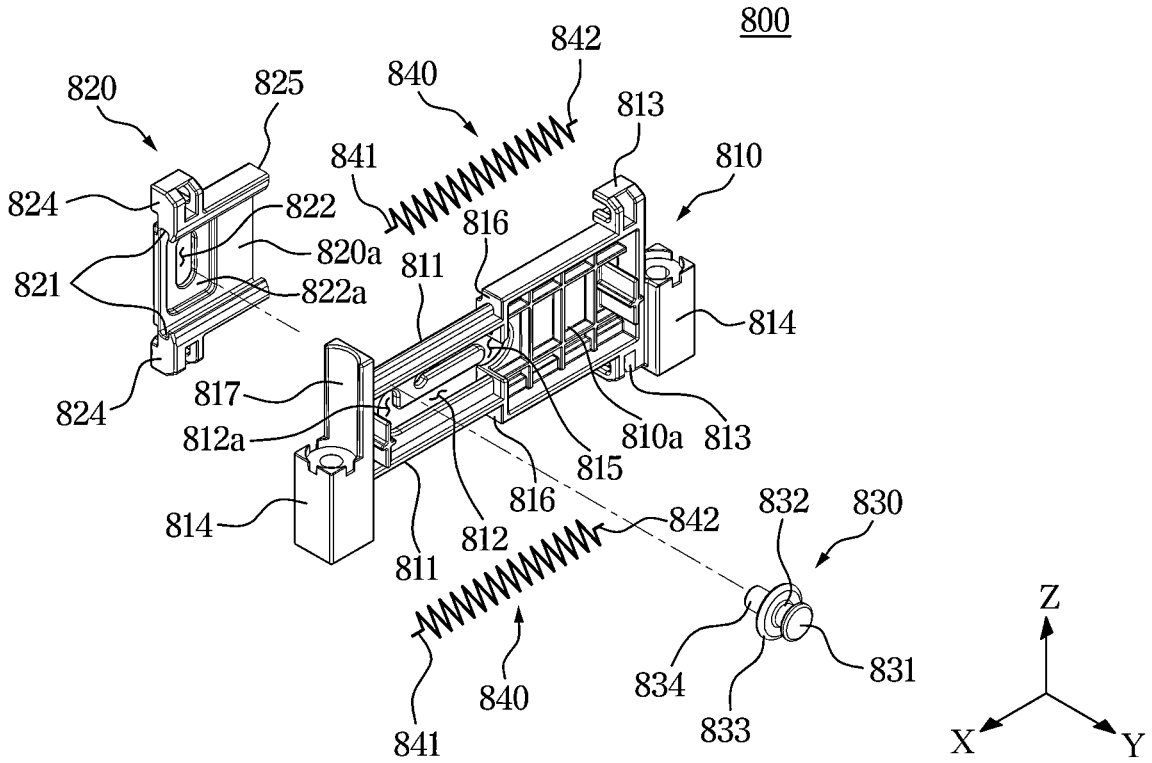
FIG. 12 is an enlarged view of the detergent supply device shown in FIGS. 3 and 4.
Figure 13:
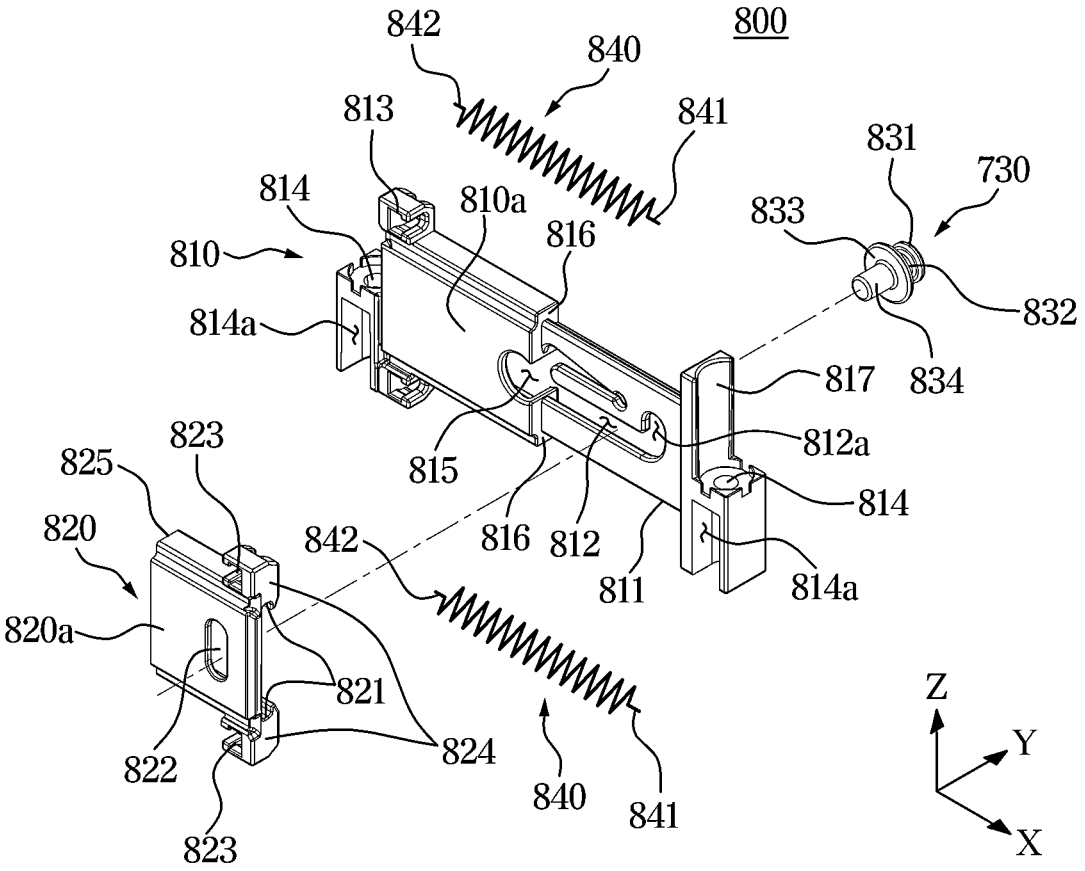
FIG. 13 is an enlarged view of the detergent supply device shown in FIGS. 3 and 4.

FIGS. 10 to 13 are enlarged views of the detergent supply device shown in FIGS. 3 and 4. FIG. 10 is an enlarged view of a portion A of the detergent supply device shown in FIGS. 3 and 4, and illustrates the first elastic member assembly. FIG. 11 is a perspective view of the first elastic member assembly of FIG. 10 rotated by 90 degrees. FIG. 12 is an enlarged view of a portion B of the detergent supply device shown in FIGS. 3 and 4, and illustrates the second elastic member assembly. FIG. 13 is a perspective view of the second elastic member assembly of FIG. 12 rotated by 90 degrees.

Referring to FIGS. 10 to 13, in the washing machine according to one embodiment, the detergent supply device 100 includes the elastic member assemblies 700 and 800. The elastic member assemblies 700 and 800 include the first assembly 700 and the second assembly 800.

The elastic member assemblies 700 and 800 include elastic members 740 and 840. The elastic members 740 and 840 may elastically press the detergent box 200 backward when the detergent box 200 is withdrawn from the housing 10. The elastic members 740 and 840 may include a first elastic member 740 and a second elastic member 840.

The first elastic member 740 may be disposed on the first side of the detergent box 200. While the detergent box 200 is being inserted into the housing 10, the first elastic member 740 may elastically press the detergent box 200 from a first position to an insertion direction. When the detergent box 200 is withdrawn from the housing 10, the first elastic member 740 may be in an extended state, and a compressive force of the first elastic member 740 may press the detergent box 200 rearward. The first elastic member 740 may be included in the first assembly 700. The first elastic member assembly 700 may be composed of only the first elastic member 740.

The first elastic member 740 may be coupled to a first moving bracket 720 and a first fixed bracket 710, respectively. A first end 742 of the first elastic member 740 may be fixed to the first fixed bracket 710, and a second end 741 of the first elastic member 740 may be fixed to the first moving bracket 720.

For example, the first end 742 of the first elastic member 740 may be fixed to an elastic member coupling portion 713 of the first fixed bracket 710, and the second end 741 of the first elastic member 740 may be fixed to an elastic member coupling portion 723 of the first moving bracket 720. The elastic member coupling portion 713 of the first fixed bracket 710 may be positioned at the rear of the elastic member coupling portion 723 of the first moving bracket 720.

The first end 742 of the first elastic member 740 may be a rear end, and the second end 741 of the first elastic member 740 may be a front end. However, the front end may be referred to as the first end 741 and the rear end may be referred to as the second end 742.

The first elastic member 740 may be stretched and/or compressed as the first moving bracket 720 moves. The first elastic member 740 may press the detergent box 200 from the first position to a third position. The third position may be positioned at the rear of the first position.

The second elastic member 840 may be disposed on the second side of the detergent box 200. While the detergent box 200 is being inserted into the housing 10, the second elastic member 840 may elastically press the detergent box 200 from a second position to the insertion direction. The second position may be positioned at the rear of the first position. When the detergent box 200 is withdrawn from the housing 10, the second elastic member 840 may be in an extended state, and a compressive force of the second elastic member 840 may press the detergent box 200 rearward. The second elastic member 840 may be included in the second assembly 800. The second elastic member assembly 800 may be composed of only the second elastic member 840.

The second elastic member 840 may be coupled to a second moving bracket 820 and a second fixed bracket 810, respectively. A first end 842 of the second elastic member 840 may be fixed to the second fixed bracket 810, and a second end 841 of the second elastic member 840 may be fixed to the second moving bracket 820.

For example, the first end 842 of the second elastic member 840 may be fixed to an elastic member coupling portion 813 of the second fixed bracket 810, and the second end 841 of the second elastic member 840 may be fixed to an elastic member coupling portion 823 of the second moving bracket 820. The elastic member coupling portion 813 of the second fixed bracket 810 may be positioned at the rear of the elastic member coupling portion 823 of the second moving bracket 820. The second elastic member 840 may be stretched and/or compressed as the second moving bracket 820 moves.

The first end 842 of the second elastic member 840 may be the rear end, and the second end 841 of the second elastic member 840 may be the front end. However, the front end may be referred to as the first end 841 and the rear end may be referred to as the second end 842.

The second elastic member 840 may be stretched and/or compressed as the second moving bracket 820 moves. The second elastic member 840 may press the detergent box 200 from the second position to the third position. The third position may be located at the rear of the second position.

The first position P1 may be a position in which the first moving bracket 720 comes into contact with a first stopper 717 of the first fixed bracket 710. For example, the first position P1 may be a position of the elastic member coupling portion 723 of the first moving bracket 720 and a position of the front end 741 of the first elastic member 740 coupled to the elastic member coupling portion 723 when a front contact surface 724 of the first moving bracket 720 comes into contact with the first stopper 717 of the first fixed bracket 710 (refer to FIGS. 14 and 15). While the detergent box 200 being is inserted into the housing 10, the first elastic member 740 may elastically press the detergent box 200 from the first position P1.

The second position P2 may be a position in which the second moving bracket 820 comes into contact the second stopper 817 of the second fixed bracket 810. For example, the second position P2 may be a position of the elastic member coupling portion 823 of second moving bracket 820 and a position of the front end 841 of the second elastic member 840 coupled to the elastic member coupling portion 823 when a front contact surface 824 of the second moving bracket 820 comes into contact with the second stopper 817 of the second fixed bracket 810 (refer to FIGS. 16 and 17). While the detergent box 200 is being inserted into the housing 10, the second elastic member 840 may elastically press the detergent box 200 from the second position P2.

The third position P3 may be a position with which the moving brackets 720 and 820 comes into contact as rear contact surfaces 725 and 825 of the moving brackets 720 and 820 come into contact with contact portions 716 and 816 of the fixed brackets 710 and 810. For example, the third position P3 may be a position of the first end of the elastic members 740 and 840 when the moving brackets 720 and 820 no longer move backwards as the rear contact surface 725 of the first moving bracket 720 comes into contact with the first contact portion 716 of the first fixed bracket 710, and the rear contact surface 825 of the second moving bracket 820 comes into contact with the second contact portion 816 of the second fixed bracket 810 (refer to FIGS. 18 and 19). The third position P3 may be a position of the first end of the elastic members 740 and 840 when the detergent box 200 and the detergent pump 400 are completely coupled and/or docked. While the detergent box 200 is being inserted into the housing 10, the elastic members 740 and 840 may elastically press the detergent box 200 to the third position.

The first elastic member 740 may be provided longer than the second elastic member 840. Accordingly, the first elastic member 740 may press the detergent box 200 from the first position P1 to the third position P3, and the second elastic member 840 may press the detergent box 200 from the second position P2 to the third position P3.

The second elastic member 840 may have a greater elastic modulus than that of the first elastic member 740. For example, an elastic modulus of the second elastic member 840 may be twice an elastic modulus of the first elastic member 740. Because the second elastic member 840 elastically presses the detergent box 200 from the rear of the first elastic member 740, an elastic pressing force greater than the first position P1 may be applied to the detergent box 200 from the second position P2.

The first elastic member 740 may allow the detergent box 200 to be automatically closed while the detergent box 200 is being inserted into the housing 10. The second elastic member 840 may start to press the detergent box 200 from the rear of the first elastic member 740, and the second elastic member 840 may function to offset a reaction force R caused by the sealing members 551 and 552 to be described later (refer to FIGS. 7, 8 and 20).

The first elastic member 740 and the second elastic member 840 may be provided in plurality. The plurality of first elastic members 740 may be respectively fixed to upper and lower portions of the first fixed bracket 710. For example, at least one of the plurality of first elastic members 740 may be fixed to an upper portion of the first fixed bracket 710 and at least one other of the plurality of first elastic members 740 may be fixed to a lower portion of the first fixed bracket 710 (refer to FIGS. 3, 4, and 9-11). The plurality of second elastic members 840 may be respectively fixed to upper and lower portions of the second fixed bracket 810. For example, at least one of the plurality of second elastic members 840 may be fixed to an upper portion of the second fixed bracket 810 and at least one other of the plurality of second elastic members 840 may be fixed to a lower portion of the second fixed bracket 810 (refer to FIGS. 3, 4, 9, and 12-14).

While the detergent box 200 is being inserted into the housing 10, the detergent pump 400 and the detergent box 200 may be docked. In order for the detergent pump 400 and the detergent box 200 to be docked, it is required that the sealing members 551 and 552 formed in the detergent pump 400 are completely inserted into the detergent box hole 220 to allow the detergent box 200 to be completely coupled to the detergent pump 400. The sealing members 551 and 552 may act as a reaction force R against docking and/or coupling of the detergent pump 400 and the detergent box 200 (refer to FIGS. 7, 8 and 20).

The elastic members 740 and 840 may elastically press the detergent box 200 toward the detergent pump 400 to allow the detergent box 200 to be completely coupled and/or docked to the detergent pump 400 despite the existence of the sealing members 551 and 552.

The elastic member assemblies 700 and 800 include the fixed brackets 710 and 810. The fixed brackets 710 and 810 may allow the elastic member assemblies 700 and 800 to be fixed to the detergent housing 140.

The fixed brackets 710 and 810 may include the first fixed bracket 710 and the second fixed bracket 810. The first fixed bracket 710 may be longer than the second fixed bracket 810. The first fixed bracket 710 may be included in the first assembly 700 and the second fixed bracket 810 may be included in the second assembly 800.

The fixed brackets 710 and 810 may be coupled to the detergent box 200. The fixed brackets 710 and 810 may be disposed between the stepped portion 146 of the detergent box 200 and the wall 200*a* of the detergent box 200.

For example, the first fixed bracket 710 may be disposed on the first side of the detergent box 200. On the first side of the detergent box 200, the first fixed bracket 710 may be coupled to the detergent box 200. The first fixed bracket 710 may be disposed between the stepped portion 146 of the detergent box 200 and the first side of the detergent box 200.

For example, the second fixed bracket 810 may be disposed on the second side of the detergent box 200. On the second side of the detergent box 200, the second fixed bracket 810 may be coupled to the detergent box 200. The second fixed bracket 810 may be disposed between the stepped portion 146 of the detergent box 200 and the second side of the detergent box 200.

The fixed brackets 710 and 810 may include housing coupling portions 714 and 814. The housing coupling portion 714 and 814 may be provided in plurality along a front and rear direction. The housing coupling portions 714 and 814 may be provided at front and rear ends of the fixed brackets 710 and 810, respectively. The housing coupling portions 714 and 814 may be screwed to the detergent housing 140. Accommodating portions 714*a* may be provided in the housing coupling portions 714 and 814. The accommodating portion 714*a* may accommodate the fixing part 148 of the detergent housing 140.

The first fixed bracket 710 may include the first housing coupling portion 714, and the second fixed bracket 810 may include the second housing coupling portion 814.

The fixed brackets 710 and 810 may guide the detergent box 200 and the moving brackets 720 and 820 from the first position and/or the second position to the third position while the detergent box 200 is being inserted into the housing 10.

For example, the first fixed bracket 710 may guide the detergent box 200 and the first moving bracket 720 from the first position to the third position while the detergent box 200 is being inserted into the housing 10.

For example, the second fixed bracket 810 may guide the detergent box 200 and the second moving bracket 820 from the second position to the third position while the detergent box 200 is being inserted into the housing 10.

The fixed brackets 710 and 810 may include guide rails 711 and 811. The guide rails 711 and 811 may allow the moving brackets 720 and 820 and the detergent box 200 to move between the first position and/or the second position and the third position. The guide rails 711 and 811 may be formed in an upper portion and a lower portion of the fixed brackets 710 and 810, respectively. The guide rails 711 and 811 may be formed to correspond to rail parts 721 and 821 of the moving brackets 720 and 820. For example, a center of the guide rails 711 and 811 may protrude upward and/or downward. The guide rails 711 and 811 may be formed over front and middle portions of the fixed brackets 710 and 810.

For example, the first fixed bracket 710 may include a first guide rail 711. The first fixed bracket 710 may allow the first moving bracket 720 and the detergent box 200 to move between the first position and the third position by using the first guide rail 711. The second fixed bracket 810 may include a second guide rail 811. The second fixed bracket 810 may allow the second moving bracket 820 and the detergent box 200 to move between the second position and the third position by using the second guide rail 811.

The first guide rail 711 may be longer than the second guide rail 811 with respect to the front and rear direction.

Guide holes 712 and 812 may be formed in the fixed brackets 710 and 810. For example, the guide holes 712 and 812 may be formed in bodies 710*a* and 810*a* of the fixed brackets 710 and 810. The guide holes 712 and 812 may provide a guide for a path along which the moving brackets 720 and 820 move. The guide holes 712 and 812 may be formed along the front and rear direction.

For example, a first guide hole 712 may be formed in the body 710*a* of the first fixed bracket 710, and a second guide hole 812 may be formed in the body 810*a* of the second fixed bracket 810. The first guide hole 712 may guide a movement path of the first moving bracket 720, and the second guide hole 812 may guide a movement path of the second moving bracket 820. The first guide hole 712 may be longer than the second guide hole 812.

Fixing holes 712*a* and 812*a* may be formed in the fixed brackets 710 and 810. For example, the fixing holes 712*a* and 812*a* may be formed in the bodies 710*a* and 810*a* of the fixed brackets 710 and 810. The fixing holes 712*a* and 812*a* may allow the guide pins 730 and 830 to be fixed when the detergent box 200 is withdrawn from the housing 10 toward the front of the first position and/or the second position. The fixing holes 712*a* and 812*a* may be formed at an upper portion of a front end of the guide holes 712 and 812. The fixing holes 712*a* and 812*a* may be connected to the guide holes 712 and 812.

For example, a first fixing hole 712*a* may be formed in the body 710*a* of the first fixed bracket 710, and a second fixing hole 812*a* may be formed in the body 810*a* of the second fixed bracket 810. The first fixing hole 712*a* may be formed in front of the second fixing hole 812*a*. The first fixing hole 712*a* may allow the first guide pin 730 to be fixed when the detergent box 200 is withdrawn forward from the first position. The second fixing hole 812*a* may allow the second guide pin 830 to be fixed when the detergent box 200 is withdrawn forward from the second position.

In addition, while the detergent box 200 is being withdrawn from the housing 10 and then inserted again, the guide pins 730 and 830 may be separated from the fixing holes 712*a* and 812*a*. Accordingly, as the guide pins 730 and 830 are separated from the fixing holes 712*a* and 812*a*, the elastic members 740 and 840 may press the detergent box 200, and a position of the fixing holes 712*a* and 812*a* may be the first position or the second position at which the elastic members 740 and 840 start to press the detergent box 200.

For example, the position of the first fixing hole 712*a* may be the first position at which the first elastic member 740 starts to press the detergent box 200, and the position of the second fixing hole 812*a* may be the second elastic member 840 at which the second elastic member 840 starts to press the detergent box 200.

The fixed brackets 710 and 810 may include the elastic member coupling portions 723 and 823. The elastic member coupling portions 723 and 823 may be formed on the rear end side of the fixed brackets 710 and 810 to allow the elastic member to be fixed to the detergent housing 140 regardless of the insertion or withdrawal of the detergent box 200.

For example, the first fixed bracket 710 may include the first elastic member coupling portion 723 to which the first elastic member 740 is coupled, and the second fixed bracket 810 may include the second elastic member coupling portion 823 to which the second elastic member 840 is coupled.

Insertion holes 715 and 815 may be formed in the fixed brackets 710 and 810. For example, the insertion holes 715 and 815 may be formed in the bodies 710*a* and 810*a* of the fixed brackets 710 and 810. The insertion holes 715 and 815 may allow the guide pins 730 and 830 to be inserted into the guide holes 712 and 812. The insertion holes 715 and 815 may have a larger area per unit length than that of the guide holes 712 and 812 and the fixing holes 712*a* and 812*a*.

For example, a first insertion hole 715 provided to allow the first guide pin 730 to be inserted into the first guide hole 712 may be formed in the body 710*a* of the first fixed bracket 710. A second insertion hole 815 provided to allow the second guide pin 830 to be inserted into the second guide hole 812 may be formed in the body 810*a* of the fixed bracket 810.

The fixed brackets 710 and 810 may include the stoppers 717 and 817. The stoppers 717 and 817 may be formed at front ends of the fixed brackets 710 and 810 to prevent the moving brackets 720 and 820 from moving beyond the first position and/or the second position. The stoppers 717 and 817 may protrude upward from the housing coupling portions 714 and 814.

For example, the first fixed bracket 710 may include the first stopper 717 preventing the first moving bracket 720 from moving forward beyond the first position. The first stopper 717 may come into contact with the front contact surface 724 of the first moving bracket 720.

For example, the second fixed bracket 810 may include the second stopper 817 preventing the second moving bracket 820 from moving forward beyond the second position. The second stopper 817 may come into contact with the front contact surface 824 of the second moving bracket 820.

When the fixed brackets 710 and 810 are coupled to the detergent housing 140, the first stopper 717 may be positioned in front of the second stopper 817. Accordingly, the first moving bracket 720 may move toward the front of the second moving bracket 820.

The fixed brackets 710 and 810 may include the contact portions 716 and 816. The contact portions 716 and 816 of the fixed brackets 710 and 810 may be provided at the rear end of the guide rails 711 and 811 to prevent the moving brackets 720 and 820 from moving beyond the third position.

For example, the first fixed bracket 710 may include the first contact portion 716 preventing the first moving bracket 720 from moving backward beyond the third position. The first contact portion 716 may come into contact with the rear contact surface 725 of the first moving bracket 720.

For example, the second fixed bracket 810 may include the second contact portion 816 preventing the second moving bracket 820 from moving backward beyond the third position. The second contact portion 816 may come into contact with the rear contact surface 825 of the second moving bracket 820.

The elastic member assemblies 700 and 800 include the moving brackets 720 and 820. The moving brackets 720 and 820 may move in conjunction with each other while the detergent box 200 is being withdrawn from or inserted into the housing 10. The moving brackets 720 and 820 may be coupled to the elastic members 740 and 840 to allow the elastic members 740 and 840 to be compressed or stretched. The moving brackets 720 and 820 may include the first moving bracket 720 and the second moving bracket 820. The first moving bracket may be included in the first assembly 700 and the second moving bracket 820 may be included in the second assembly 800.

The moving brackets 720 and 820 may be coupled to the detergent box 200 through the guide pins 730 and 830. The guide pins 730 and 830 may be mounted on the mounting portion 240 of the detergent box 200. The moving brackets 720 and 820 may be disposed between the stepped portion 146 of the detergent box 200 and the wall of the detergent box 200.

For example, the first moving bracket 720 may be disposed on the first side of the detergent box 200 through the first guide pin 730. The first moving bracket 720 may be coupled to the detergent box 200 through the mounting portion 240 and the first guide pin 730 provided on the first side of the detergent box 200. The first moving bracket 720 may be disposed between the stepped portion 146 of the detergent box 200 and the first side of the detergent box 200.

For example, the second moving bracket 820 may be disposed on the second side of the detergent box 200 through the second guide pin 830. The second moving bracket 820 may be coupled to the detergent box 200 through the mounting portion 240 and the second guide pin 830 provided on the second side of the detergent box 200. The second moving bracket 820 may be disposed between the stepped portion 146 of the detergent box 200 and the second side of the detergent box 200.

The moving brackets 720 and 820 may guide the detergent box 200 from the first position and/or the second position to the third position while the detergent box 200 is being inserted into the housing 10.

For example, the first moving bracket 720 may guide the detergent box 200 from the first position to the third position while the detergent box 200 is being inserted into the housing 10.

For example, the second moving bracket 820 may guide the detergent box 200 from the second position to the third position while the detergent box 200 is being inserted into the housing 10.

The moving brackets 720 and 820 may include the rail parts 721 and 821. The rail parts 721 and 821 may allow the detergent box 200 to move between the first position and/or the second position and the third position. The rail parts 721 and 821 may be formed on upper and lower portions of the bodies 720*a* and 820*b*, respectively. The rail parts 721 and 821 may be formed to correspond to the guide rails of the fixed brackets 710 and 810.

For example, the first moving bracket 720 may include the first rail part 721. The first rail part 721 may allow the detergent box 200 to move between the first position and the third position. The second moving bracket 820 may include the second rail part. The second rail part 821 may allow the detergent box 200 to move between the second position and the third position.

Pin holes 722 and 822 may be formed in the moving brackets 720 and 820. For example, the pin holes 722 and 822 may be formed in the bodies 720*a* and 820*a* of the moving brackets 720 and 820. The pin holes 722 and 822 may extend in a vertical direction. The pin holes 722 and 822 may allow the guide pins 730 and 830 to be separated from and/or mounted to the mounting portion 240 as the detergent box 200 moves. The pin holes 722 and 822 may be formed at positions corresponding to the mounting holes 241 to allow the moving brackets 720 and 820 to be mounted to the detergent box 200.

For example, the first pin hole 722 may be formed in the body 720*a* of the first moving bracket 720, and the second pin hole 822 may be formed in the body 820*a* of the second moving bracket 820.

Recesses 722*a* and 822*a* may be formed in regions, in which the pin holes 722 and 822 are formed, of the bodies 720*a* and 820*a* of the moving brackets 720 and 820.

The moving brackets 720 and 820 may include the elastic member coupling portions 723 and 823. The elastic member coupling portions 723 and 823 may be formed at the upper and lower end portions on the front end of the bodies 720*a* and 820*a* of the moving brackets 720 and 820 so as to allow the elastic members 740 and 840 to be stretched or compressed according to the insertion or withdrawal of the detergent box 200.

For example, the first moving bracket 720 may include the first elastic member coupling portion 723 to which the first elastic member 740 is coupled, and the second moving bracket 820 may include the second elastic member coupling portion 823 to which the second elastic member 840 is coupled.

The elastic member assemblies 700 and 800 include the guide pins 730 and 830. The guide pins 730 and 830 may include the first guide pin 730 and the second guide pin 830. The first guide pin 730 may be included in the first assembly 700, and the second guide pin 830 may be included in the second assembly 800.

The guide pins 730 and 830 may be coupled to the detergent box 200. The guide pins 730 and 830 may be mounted on the mounting portion 240 of the detergent box 200. The guide pins 730 and 830 may be disposed between the stepped portion 146 of the detergent box 200 and the wall of the detergent box 200.

For example, the first guide pin 730 may be disposed on the first side of the detergent box 200. The first guide pin 730 may be mounted on the mounting portion 240 provided on the first side of the detergent box 200. The first guide pin 730 may be disposed between the stepped portion 146 of the detergent box 200 and the first side of the detergent box 200.

For example, the second guide pin 830 may be disposed on the second side of the detergent box 200. The second guide pin 830 may be mounted on the mounting portion 240 provided on the second side of the detergent box 200. The second guide pin 830 may be disposed between the stepped portion 146 of the detergent box 200 and the second side of the detergent box 200.

The guide pins 730 and 830 may move in conjunction with each other while the detergent box 200 is being withdrawn from or inserted into the housing 10. As the detergent box 200 moves, the guide pins 730 and 830 may move along the guide holes 712 and 812 formed in the fixed brackets 710 and 810.

For example, the first guide pin 730 may move along the first guide hole 712 as the detergent box 200 moves, and the second guide pin 830 may move along the second guide hole 812 as the detergent box 200 moves. The first guide pin 730 may move between the first position and the third position, and the second guide pin 830 may move between the second position and the third position.

The guide pins 730 and 830 may be inserted into the insertion holes 715 and 815 and then disposed in the guide holes 712 and 812. The guide pins 730 and 830 may be positioned in the fixing holes 712*a* and 812*a* when the detergent box 200 is withdrawn from the housing 10 toward the front of the first position and/or the second position.

For example, the first guide pin 730 may be positioned in the first fixing hole 712*a* when the detergent box 200 is withdrawn toward the front of the first position. The second guide pin 830 may be positioned in the second fixing hole 812*a* when the detergent box 200 is withdrawn toward the front of the second position.

The guide pins 730 and 830 may include first separation preventing portions 731 and 831, necks 732 and 832, second separation preventing portions 733 and 833, and insertion portions 744 and 844. The first guide pin 730 may include a first separation preventing portion 731, a neck 732, a second separation preventing portion 733, and an insertion portion 734. The second guide pin 830 may include a first separation preventing portion 831, a neck 832, a second separation preventing portion 833, and an insertion portion 834.

The first separation preventing portions 731 and 831 may be formed at one end of the guide pins 730 and 830. For example, the first separation preventing portions 731 and 831 may be provided at one end, which faces the outside of the detergent box 200, of the guide pins 730 and 830. The first separation preventing portions 731 and 831 may have a larger cross-sectional area than the necks 732 and 832. The first separation preventing portions 731 and 831 may be referred to as heads 731 and 831.

The necks 732 and 832 may be formed between the first separation preventing portions 731 and 831 and the second separation preventing portions 733 and 833. The necks 732 and 832 may allow the guide pins 730 and 830 to move along the guide holes 712 and 812. The first separation preventing portions 731 and 831 and the second separation preventing portions 733 and 833 may prevent the necks 732 and 832 from being separated from the guide holes 712 and 812. The first separation preventing portions 731 and 831 and the second separation preventing portions 733 and 833 may be provided at opposite ends of the necks 732 and 832.

The second separation preventing portion 733 or 833 may be provided at one end of the neck 732 or 832. The second separation preventing portion may have a larger cross-sectional area than the first separation preventing portions 731 and 831. The second separation preventing portions 733 and 833 may be disposed in the recesses 722*a* and 822*a* of the moving brackets 720 and 820 when the elastic member assemblies 700 and 800 are coupled to the detergent box 200. The second separation preventing portions 733 and 833 may allow the insertion portions 744 and 844 to stably move in the pin holes 722 and 822 in the vertical direction without the separation.

When the elastic member assemblies 700 and 800 are coupled to the detergent box 200, the insertion portions 744 and 844 may extend toward the detergent box 200 from the second separation preventing portions 733 and 833. The insertion portions 744 and 844 may be inserted into the mounting hole 241. The insertion portions 744 and 844 may be separated from or mounted to the mounting hole 241 as the detergent box 200 is withdrawn from or inserted into the housing 10.

Figure 14:
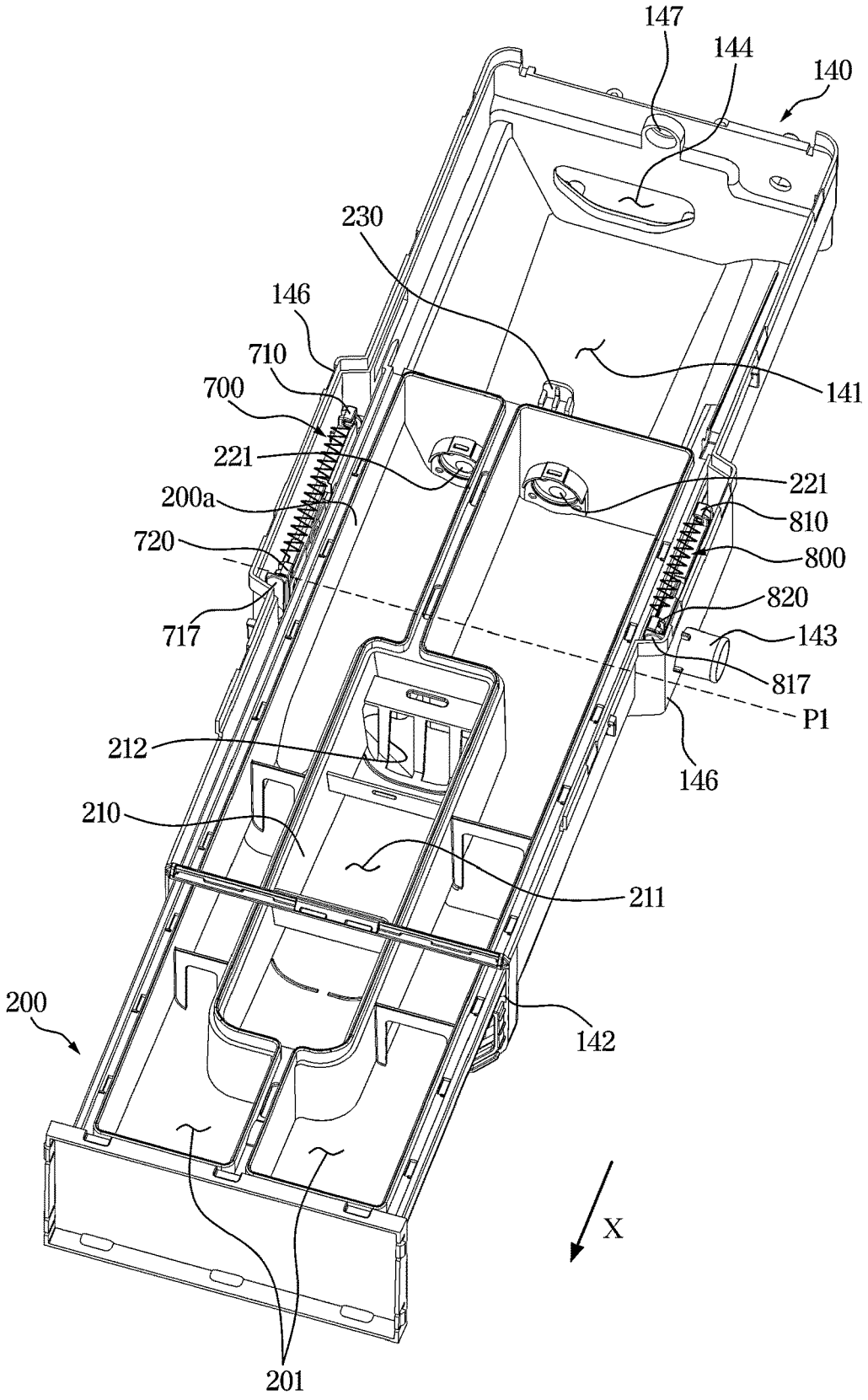
FIG. 14 is a perspective view illustrating a state in which the detergent box is withdrawn from the detergent supply device in the washing machine according to one embodiment.
Figure 15:
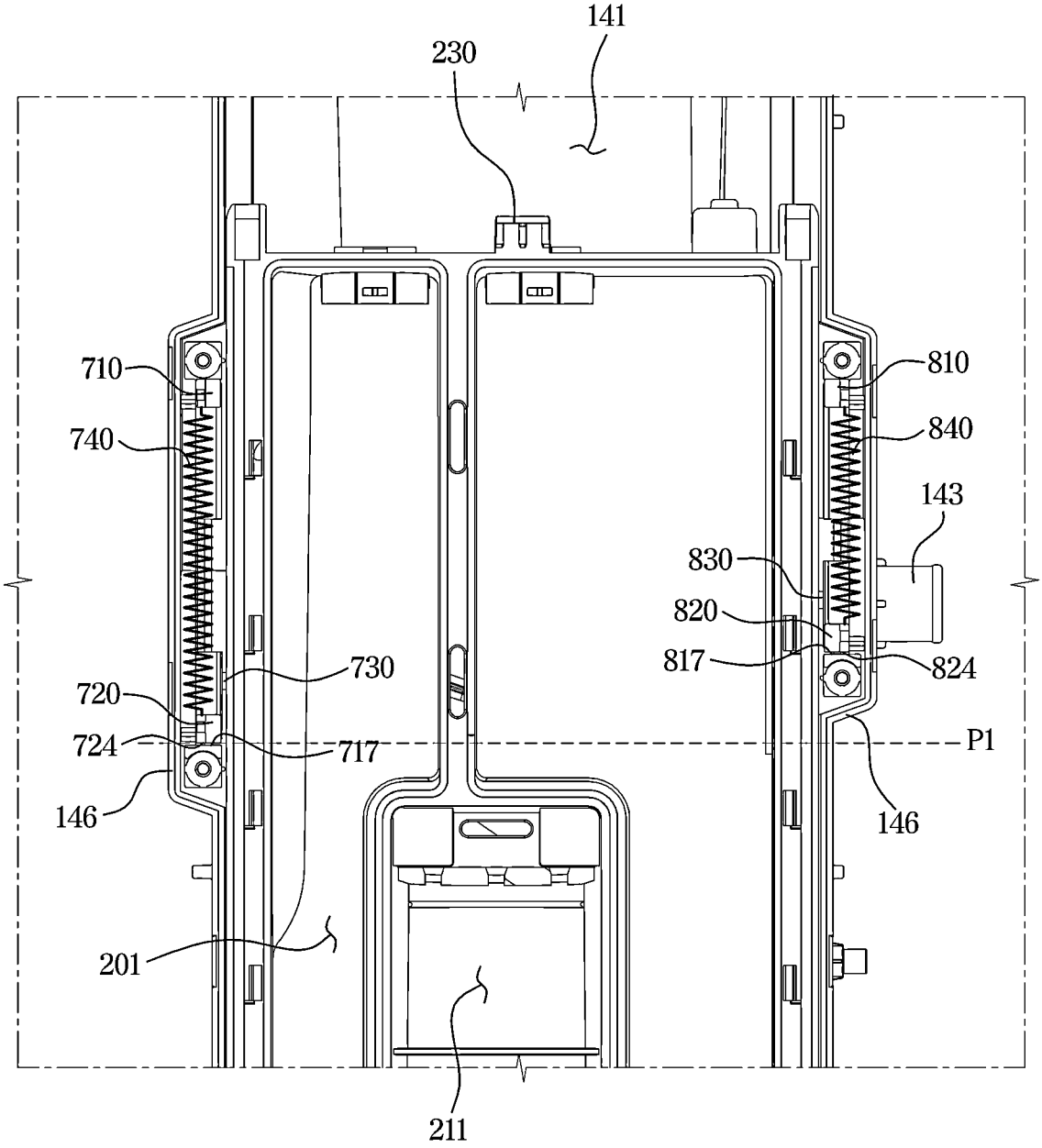
FIG. 15 is a plan view of the washing machine shown in FIG. 14.

FIG. 14 is a perspective view illustrating a state in which the detergent box is withdrawn from the detergent supply device in the washing machine according to one embodiment. FIG. 15 is a plan view of the washing machine shown in FIG. 14.

FIGS. 14 and 15 illustrate the detergent box 200 is inserted to be docked and/or coupled to the detergent pump 400.

In FIGS. 14 and 15, the first fixed bracket 710 and the first moving bracket 720 may be in a contact state, and the second fixed bracket 810 and the second moving bracket 820 may be in a contact state. For example, the first stopper 717 and the front contact surface 724 of the first moving bracket 720 may be in a contact state, and the second stopper 817 and the front contact surface 824 of the second moving bracket 820 may be in a contact state.

Referring to FIGS. 14 and 15, in the washing machine according to one embodiment, the elastic member assemblies 700 and 800 may be disposed between the detergent housing 140 and the detergent box 200. For example, the elastic member assemblies 700 and 800 may be disposed between the stepped portion 146 of the detergent housing 140 and the wall 200*a* of the detergent box 200.

In the washing machine according to one embodiment, the detergent box 200 may be withdrawn from the housing 10 and the detergent housing 140. The detergent box 200 may be withdrawn from the housing 10 to allow the moving brackets 720 and 820 to pass through a position in which the moving brackets 720 and 820 come into contact with the stoppers of the fixed brackets 710 and 810. Even when the first moving bracket 720 is in contact with the first stopper 717 and the first moving bracket 720 is not moved, the detergent box 200 may be withdrawn further forward. For example, the detergent box 200 may pass through a position, in which the front contact surfaces 724 and 824 of the moving brackets 720 and 820 come into contact with the stoppers 717 and 817 of the fixed brackets 710 and 810, and then be withdrawn from the housing 10. One end of the first elastic member 740 may be located at the first position P1.

The first position P1 may be a position in which the first moving bracket 720 comes into contact with the first stopper 717 of the first fixed bracket 710. For example, the first position may be a position of the elastic member coupling portion 723 of the first moving bracket 720 and a position of the front end 741 of the first elastic member 740 coupled to the elastic member coupling portion 723 when the front contact surface 724 of the first moving bracket 720 comes into contact with the first stopper 717 of the first fixed bracket 710.

The first moving bracket 720 and the second moving bracket 820 may not move further forward by the stoppers 717 and 817, and thus as the detergent box 200 moves forward, the guide pins 730 and 830 may move upward in the pin holes 722 and 822 along the mounting guide 242 toward the fixing holes 712*a* and 812*a*, and the guide pins 730 and 830 may be separated from the mounting portion 240. For example, as the detergent box 200 moves forward, the second guide pin 830 may be separated from the mounting portion 240 along the mounting guide 242 provided on the second side of the detergent box 200, and as the detergent box 200 moves further forward, the first guide pin 730 may be separated from the mounting portion 240 along the mounting guide 242 provided on the first side of the detergent box 200.

At this time, the elastic members 740 and 840 may be in a stretched state. However, because the first guide pin 730 is fixed to the first fixing hole 712*a* and the second guide pin 830 is fixed to the second fixing hole 812*a*, an elastic force that the elastic members 740 and 840 press the detergent box 200 backward may not be applied.

Figure 16:
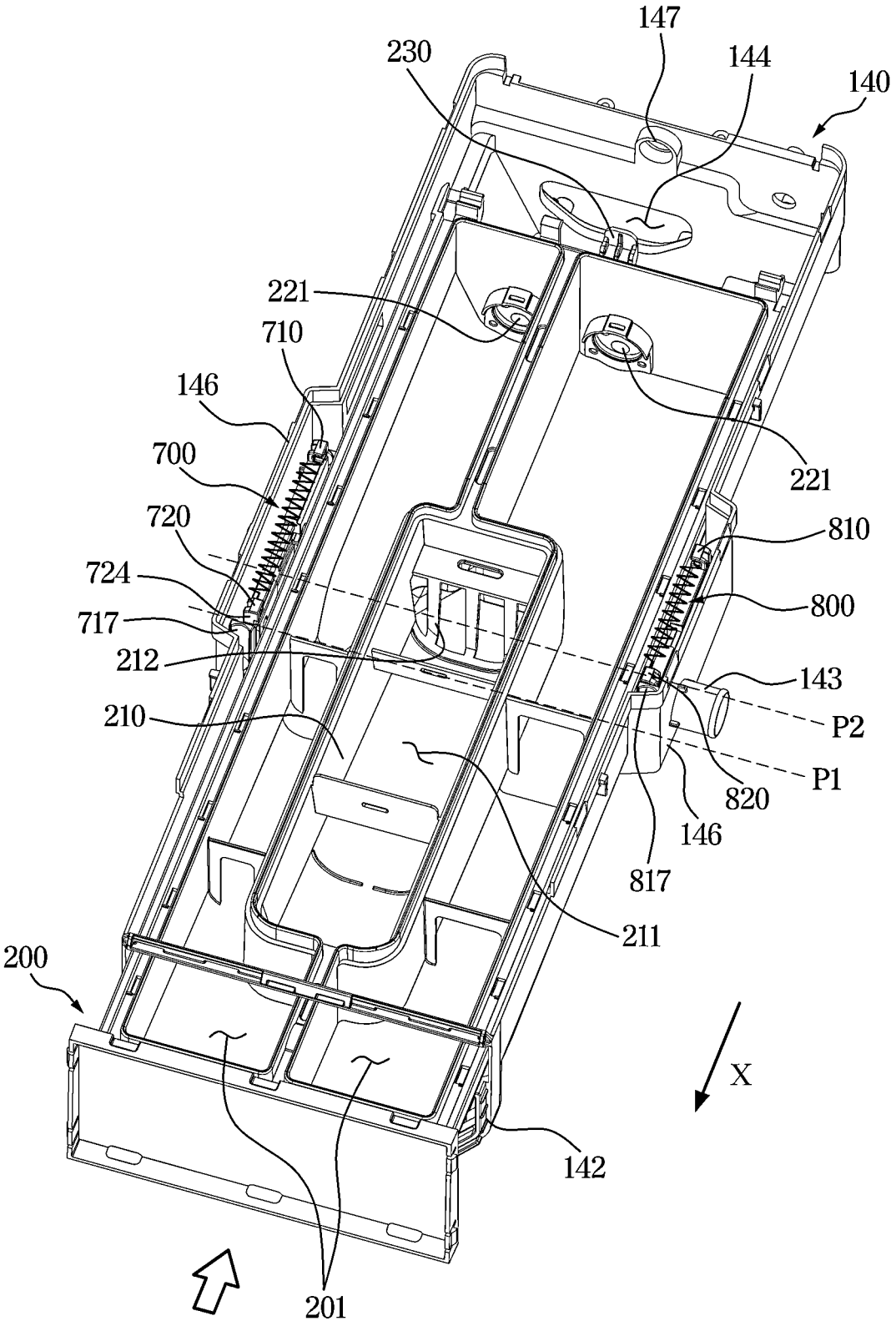
FIG. 16 is a perspective view illustrating a state in which the detergent box is inserted into the washing machine according to one embodiment.
Figure 17:
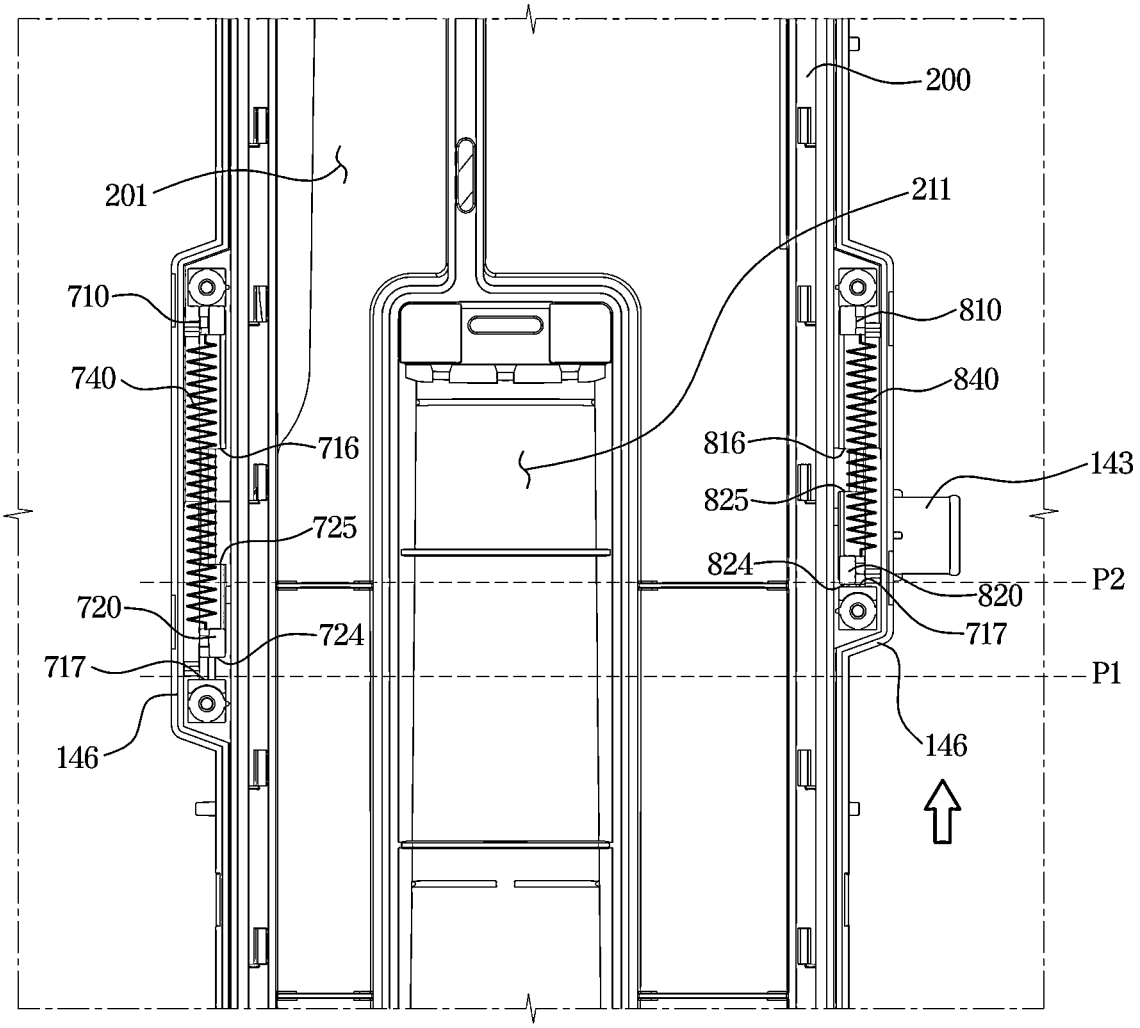
FIG. 17 is a plan view of the washing machine shown in FIG. 16.

FIG. 16 is a perspective view illustrating a state in which the detergent box is inserted into the washing machine according to one embodiment. FIG. 17 is a plan view of the washing machine shown in FIG. 16.

FIGS. 16 and 17 illustrate that the first elastic member 740 presses the detergent box 200 while the detergent box 200 is being docked and/or coupled to the detergent pump 400.

In FIGS. 16 and 17, the first fixed bracket 710 may be spaced apart from the first moving bracket 720, and the second fixed bracket 810 may be in contact with the second moving bracket 820. For example, the first stopper 717 may be spaced apart from the front contact surface 724 of the first moving bracket 720, and the second stopper 817 may be in contact with the front contact surface 824 of the second moving bracket 820.

Referring to FIGS. 16 and 17, in the washing machine according to one embodiment, the detergent box 200 may be inserted into the housing 10 and the detergent housing 140. For example, the detergent box 200 may be inserted into the housing 10 to the first position P1 that is a position in which the moving brackets 720 and 820 come into contact with the stoppers 717 and 817 of the fixed brackets 710 and 810.

As the detergent box 200 moves backward and is inserted into the housing 10, the guide pins 730 and 830 located in the fixing holes 712*a* and 812*a* may be positioned in the mounting hole 241 again along the mounting guide 242. As the guide pins 730 and 830 move downward along the mounting guide 242, the guide pins 730 and 830 may move downward in the pin holes 722 and 822 and the fixing holes 712*a* and 812*a*. For example, as the detergent box 200 moves backward, the first guide pin 730 may be mounted on the mounting portion 240 along the mounting guide 242 provided on the first side of the detergent box 200.

The first guide pin 730 may be mounted on the mounting portion 240, and separated from the first fixing hole 712*a* and then positioned in the first guide hole 712. Because the first guide pin 730 is located in the first guide hole 712 instead of the first fixing hole 712*a*, the first elastic member 740 may elastically press the detergent box 200 backward from the first position.

The first position P1 may be a position in which the first moving bracket 720 comes into contact with the first stopper 717 of the first fixed bracket 710. For example, the first position may be a position of the elastic member coupling portion 723 of the first moving bracket 720 and a position of the front end 741 of the first elastic member 740 coupled to the elastic member coupling portion 723 when the front contact surface 724 of the first moving bracket 720 comes into contact with the first stopper 717 of the first fixed bracket 710.

For example, the front contact surface 724 of the first moving bracket 720 may be separated from the first stopper 717 of the first fixed bracket 710 from the first position P1, and then the first moving bracket 720 may move backward. Further, the first elastic member 740 and the first guide pin 730 may press the detergent box 200 backward.

However, because the second guide pin 830 is separated from the mounting hole provided on the second side of the detergent box 200 and is fixed to the second fixing hole 812*a*, a force that the second elastic member 840 elastically presses the box 200 backward may not be applied. When the second guide pin 830 is at the second position P2, for example, when one end of the second elastic member 840 is at the second position P2, the second elastic member 840 may apply an elastic force that presses the detergent box 200 backward.

The second position P2 may be a position in which the second moving bracket 820 comes into contact the second stopper 817 of the second fixed bracket 810. For example, the second position P2 may be a position of the elastic member coupling portion 823 of the second moving bracket 820 and a position of the front end 841 of the second elastic member 840 coupled to the elastic member coupling portion 823 when the second moving bracket 820 comes into contact with the second stopper 817 of the second fixed bracket 810.

For example, the front contact surface 824 of the second moving bracket 820 may be separated from the second stopper 817 of the second fixed bracket 810 from the second position P2 and then the second moving bracket 820 may move backward. Accordingly, the second elastic member 840 and the second guide pin 830 may press the detergent box 200 backward.

In FIGS. 16 and 17, the front end 741 of the first elastic member 740 is positioned between the first position P1 and the second position P2.

Figure 18:
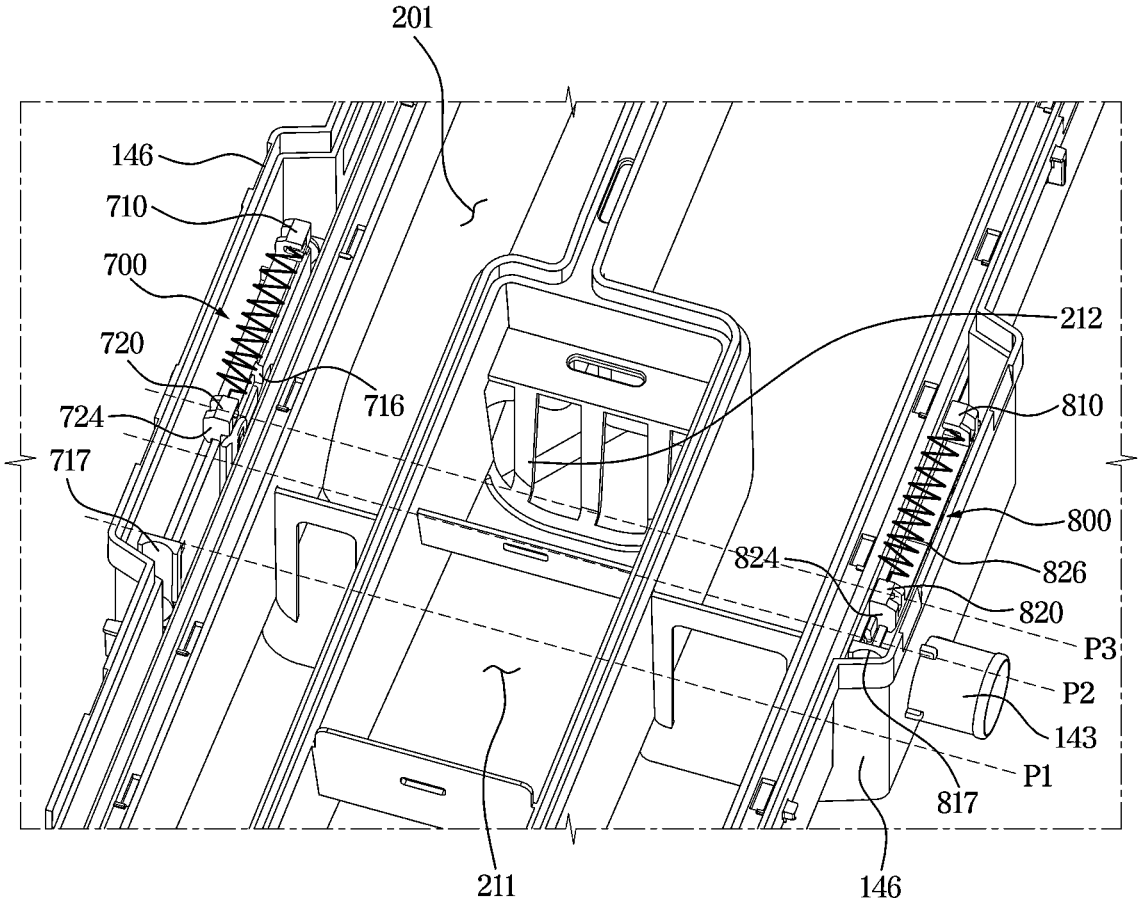
FIG. 18 is a perspective view illustrating a state in which the detergent box is inserted into the washing machine according to one embodiment.
Figure 19:
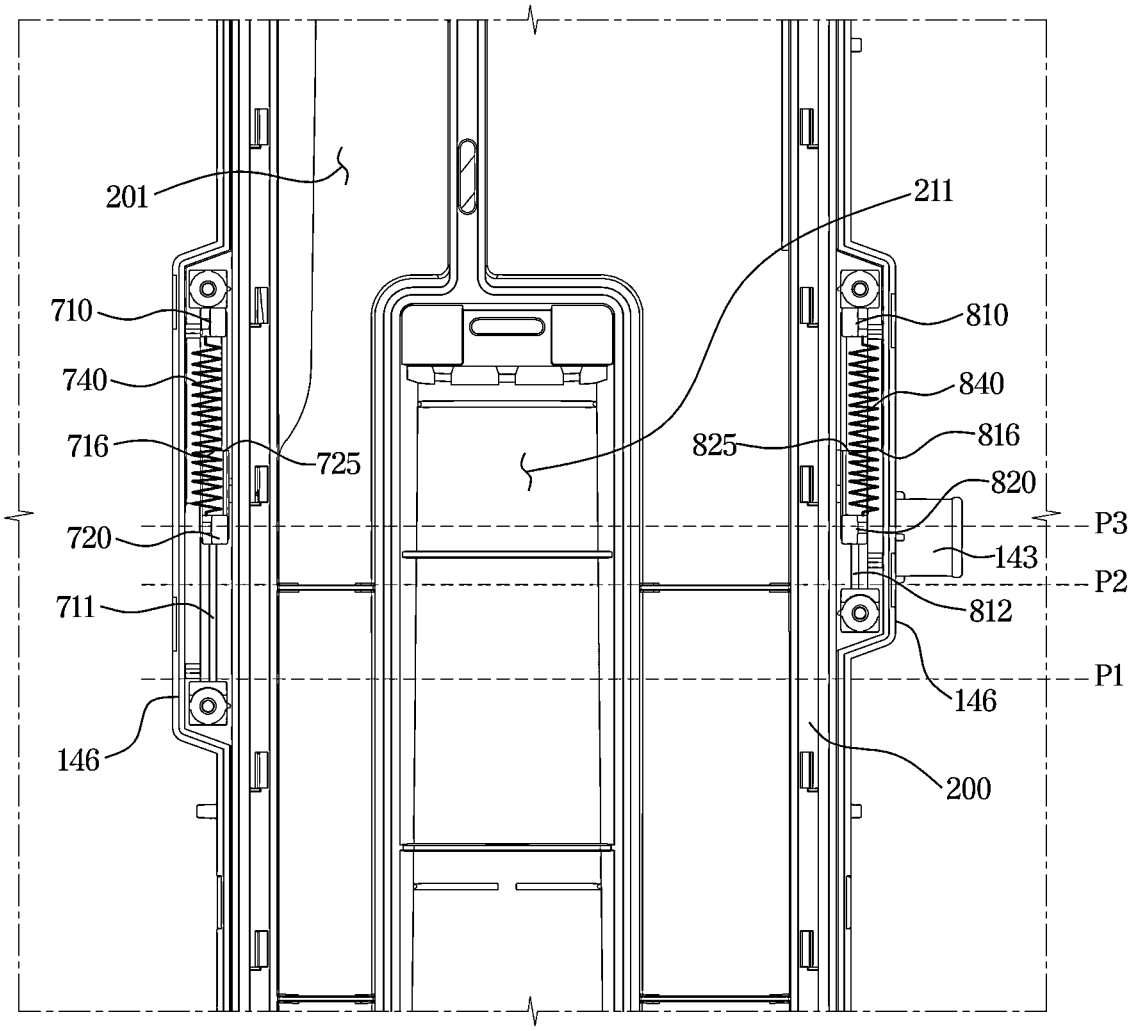
FIG. 19 is a plan view of the washing machine shown in FIG. 18.

FIG. 18 is a perspective view illustrating a state in which the detergent box is inserted into the washing machine according to one embodiment. FIG. 18 illustrates a part of the detergent box and detergent housing. FIG. 19 is a plan view of the washing machine shown in FIG. 18.

FIGS. 18 and 19 illustrate that the detergent box 200 is completely docked and/or coupled to the detergent pump 400 by being pressed by the elastic members 740 and 840.

In FIGS. 18 and 19, the first stopper 717 may be spaced apart from the front contact surface 724 of the first moving bracket 720, and the second stopper 817 may be spaced apart from the front contact surface 824 of the second moving bracket 820. Further, the first contact portion 716 may be spaced apart from the rear contact surface 725 of the first moving bracket 720, and the second contact portion 816 may be spaced apart from the rear contact surface 825 of the second moving bracket 820.

Referring to FIGS. 18 and 19, in the washing machine according to one embodiment, the detergent box 200 may be further inserted into the housing 10 and the detergent housing 140 than the detergent box 200 shown in FIGS. 16 and 17. For example, the detergent box 200 may be inserted into a position in which the support 230 of the detergent box 200 comes into contact with the support 147 of the detergent housing 140. At this time, the detergent box 200 may be inserted into the housing 10 to allow one end of the elastic members 740 and 840 and the guide pins 730 and 830 to move to the third position P3 in which the rear surfaces 725 and 825 of the moving brackets 720 and 820 come into contact with the contact portions 716 and 816 of the fixed brackets 710 and 810.

As the detergent box 200 moves further backward and is inserted into the housing 10, the guide pins 730 and 830 located in the fixing holes 712*a* and 812*a* may be positioned in the mounting hole 241 again along the mounting guide 242. As the guide pins 730 and 830 move downward along the mounting guide 242, the guide pins 730 and 830 may move downward in the pin holes 722 and 822 and the fixing holes 712*a* and 812*a*. For example, as the detergent box 200 moves further backward, the second guide pin 830 may be mounted on the mounting portion 240 along the mounting guide 242 provided on the second side of the detergent box 200.

The second guide pin 830 may be mounted on the mounting portion 240, separated from the second fixing hole 812*a* and positioned in the second guide hole 812. Because the second guide pin 830 is located in the second guide hole 812 instead of the second fixing hole 812*a*, the second elastic member 840 may elastically press the detergent box 200 backward from the second position.

The second position P2 may be a position in which the second elastic member 840 and the second guide pin 830 elastically press the detergent box 200 backward as the front contact surface 824 of the second moving bracket 820 is separated from the second stopper 817 of the second fixed bracket 810 to allow the second moving bracket 820 to move backward.

The first elastic member 740 and the second elastic member 840 may press the detergent box 200 to the third position P3 of the guide holes 712 and 812.

The third position P3 may be a position with which the moving brackets 720 and 820 comes into contact as the rear contact surfaces 725 and 825 of the moving brackets 720 and 820 come into contact with contact portions 716 and 816 of the fixed brackets 710 and 810. For example, the third position P3 may be a position of the first ends 741 and 841 of the elastic members 740 and 840 when the moving brackets 720 and 820 no longer move backwards as the rear contact surface 725 of the first moving bracket 720 comes into contact with the first contact portion 716 of the first fixed bracket 710, and the rear contact surface 825 of the second moving bracket 820 comes into contact with the second contact portion 816 of the second fixed bracket 810.

Figure 20:
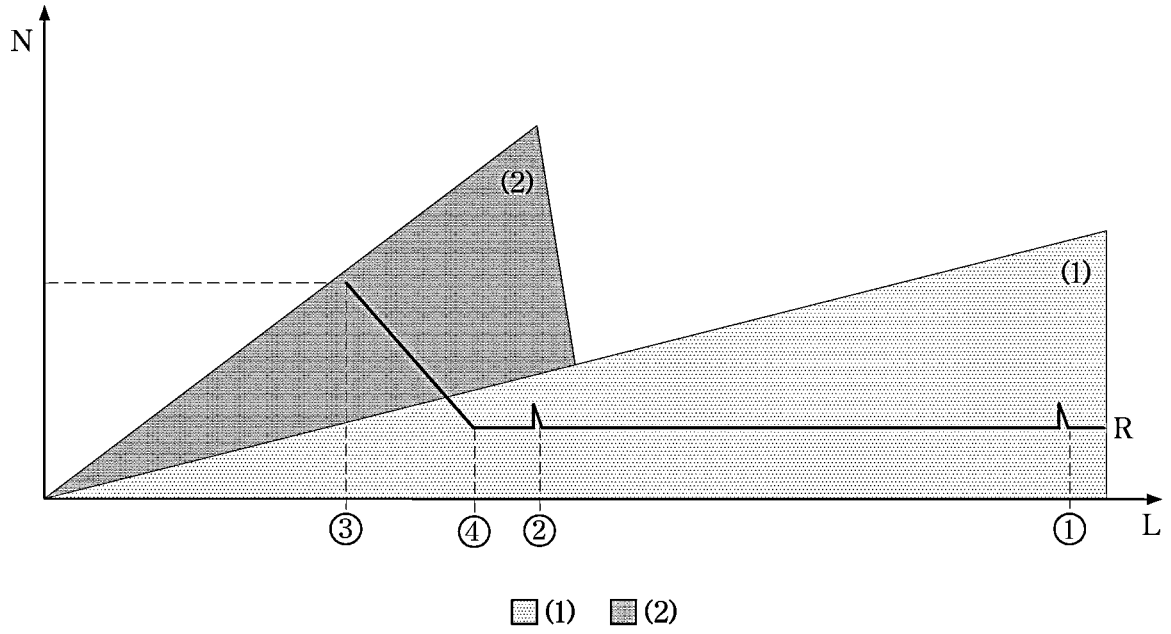
FIGS. 20 to 22 are views illustrating a relationship between the detergent box and an elastic member in the washing machine according to one embodiment.
Figure 21:
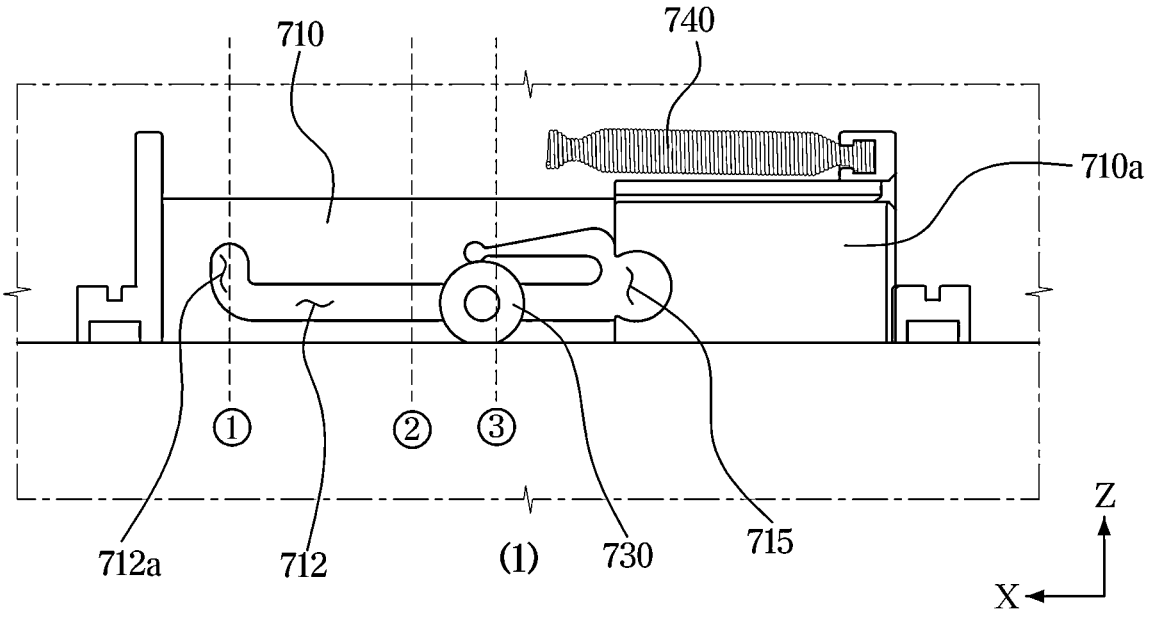
Figure 22:
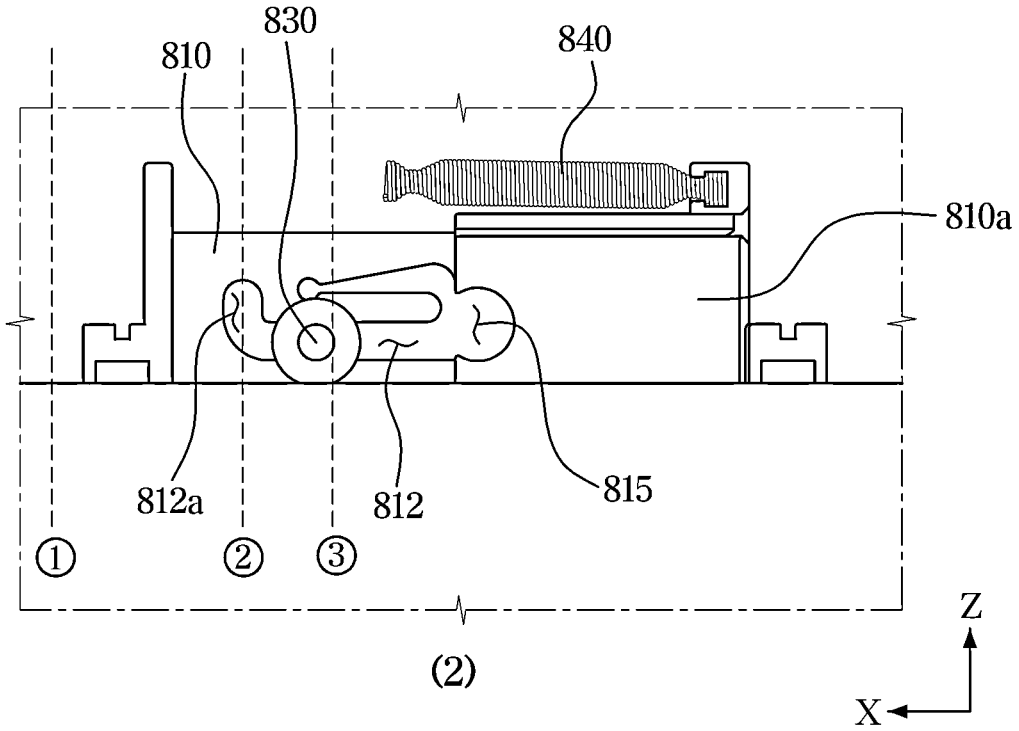

FIGS. 20 to 22 are views illustrating a relationship between the detergent box and an elastic member in the washing machine according to one embodiment.

FIG. 20 illustrates an elastic force of the elastic members 740 and 840 according to the positions of the first ends 741 and 841 of the elastic members 740 and 840. In FIG. 20, a X axis represents a length of the elastic members 740 and 840, and a Y axis represents an elastic force. A graph shown in FIG. 20 illustrates a force R required for the detergent box 200 to be docked and/or coupled to the detergent pump 400 while the detergent box 200 is being inserted.

FIG. 21 illustrates the position of the first guide hole 712 according to the position of the front end 741 of the first elastic member 740 in the first assembly 700. In FIG. 21, it is illustrated that the first elastic member 740 is not coupled to the first moving bracket 720 because the first moving bracket 740 is omitted.

FIG. 22 illustrates the position of the second guide hole 812 according to the position of the front end 841 of the second elastic member 840 in the second assembly 800. In FIG. 22, it is illustrated that the second elastic member 840 is not coupled to the second moving bracket 820 because the second moving bracket 820 is omitted.

Referring to FIGS. 20 to 22, in the washing machine according to one embodiment, the first position P1 (①) may be a position of the elastic member coupling portion 723 of the first moving bracket 720 and a position of the front end 741 of the first elastic member 740 coupled to the elastic member coupling portion 723 when the first moving bracket 720 comes into contact with the first stopper 717 of the first fixed bracket 710.

In the first position P1 (①), the first guide pin 730 may be positioned in the first fixing hole 712*a*, and the second guide pin 830 may also be positioned in the second fixing hole 812*a*.

While the detergent box 200 is being inserted into the housing 10, an additional force may be required to move the first guide pin 730 from the first fixing hole 712*a* to the first guide hole 712 right after the elastic members 740 and 840 passes through the first position P1 and moves backward. At this time, because a force that the first elastic member 740 presses the detergent box 200 backward is applied, the detergent box 200 may move backward although a user does not press the detergent box 200.

In the washing machine according to one embodiment, the second position P2 (②) may be a position of the elastic member coupling portion 823 of the second moving bracket 820 and a position of the front end 841 of the second elastic member 840 coupled to the elastic member coupling portion 823 when the second moving bracket 820 comes into contact with the second stopper 817 of the second fixed bracket 810.

In the second position P2 (②), the first guide pin 730 may be positioned in the first guide hole 712, and the second guide pin 830 may be positioned in the second fixing hole 812*a*.

An additional force may be required to move the second guide pin 830 from the second fixing hole 812*a* to the second guide hole 812 right after the elastic members 740 and 840 passes through the second position P2 and moves backward as the detergent box 200 is further inserted into the housing 10. At this time, in addition to a force that the first elastic member 740 presses the detergent box 200 backward, a force that the second elastic member 840 presses the detergent box 200 backward may be applied and thus the detergent box 200 may move backward although a user does not press the detergent box 200.

In the washing machine according to one embodiment, the third position P3 (③) may be a position of the first ends 741 and 841 of the elastic members 740 and 840 when the moving brackets 720 and 820 no longer move backwards as the rear contact surface 725 of the first moving bracket 720 comes into contact with the first contact portion 716 of the first fixed bracket 710, and the rear contact surface 825 of the second moving bracket 820 comes into contact with the second contact portion 816 of the second fixed bracket 810.

The detergent box 200 may be further inserted into the housing 10 and thus the elastic members 740 and 840 may head to the fourth position ④ by passing through the second position P2. When the detergent pump 400 and the detergent box 200 are docked, a strong force may be required to allow the detergent suction part 520 and the sensing member 530 to be inserted into the detergent box hole 220 due to the sealing members 551 and 552 of the detergent pump 400. The sealing members 551 and 552 may act as a reaction force R against docking and/or coupling of the detergent pump 400 and the detergent box 200. For example, a frictional force may occur between the sealing members 551 and 552 and the wall 200*a* of the detergent box forming the detergent box hole 220.

The fourth position ④ may be a portion in which the sealing member of the detergent pump 400 and the detergent box hole 220 start to come into contact with each other when the detergent box 200 and the detergent pump 400 are docked. Because the plurality of sealing members 551 and 552 is provided in a direction toward the detergent box 200, the detergent box hole 220 may come into contact with the first sealing member 551 and 552 at the fourth position ④, and the reaction force R may gradually become stronger due to the additional sealing members 551 and 552 to the third position P3 in which the detergent pump 400 and the detergent box 200 are completely docked and/or coupled.

Until the front end 741 of the first elastic member 740 and the front end 841 of the second elastic member 840 reach the third position P3, the first elastic member 740 and the second elastic member 840 may press the detergent box 200 backward, and because the pressing force of the elastic members 740 and 840 is greater than the reaction force R of the sealing members 551 and 552, the detergent box 200 and the detergent pump 400 may be completely docked and/or coupled.

Therefore, when a user inserts the detergent box 200 into the housing 10, the elastic members 740 and 840 may allow the detergent box 200 to be completely inserted into the housing 10 as long as the user inserts the detergent box 200 to a predetermined position, without an excessive force.

In addition, the second elastic member 840 may have a greater elastic modulus than the first elastic member 740, and the second elastic member 840 may elastically press the detergent box 200 from the rear of the first elastic member 740. Therefore, an elastic pressing force greater than that in the first position P1 may be added to the detergent box 200 from the second position P2. The second elastic member 840 may act at a relatively short distance.

For example, the first elastic member 740 may allow the detergent box 200 to be automatically inserted while the detergent box 200 is being inserted into the housing 10. The second elastic member 840 may start to press the detergent box 200 from the rear of the first elastic member 740, and function to offset the reaction force R caused by the sealing members 551 and 552 to be described later. Therefore, an automatic insertion function of the detergent box 200 of the first elastic member 740 that allows the detergent box 200 to be inserted into the housing 10 may occur from the first position P1. A reaction force offset function of the second elastic member 840 that allows the detergent box 200 to be completely docked to the detergent pump 400 may occur from the second position P2.

Therefore, because the second elastic member 840 operates when the detergent box 200 is completely docked and/or coupled to the detergent pump 400 or completely inserted into the housing 10, a user can smoothly and completely insert the detergent box 200 into the housing 10 without the user' convenience or a jammed finger due to a strong elastic pressing force. Therefore, it is possible to improve the user's convenience and user experience.

The washing machine according to one embodiment may include the housing 10, the tub 20 disposed in the housing, and the detergent box 200 capable of storing detergent to supply the detergent to the inside of the tub and configured to move in the withdrawal direction in which the detergent box 200 is withdrawn from the housing 10 and in the insertion direction in which the detergent box 200 is inserted into the housing 10, and the elastic members 740 and 840 configured to press the detergent box 200 to the insertion direction while the detergent box 200 is being withdrawn from the housing 10.

In the washing machine according to one embodiment, the elastic members 740 and 840 may include the first elastic member 740 disposed on the first side of the detergent box 200, and configured to press the detergent box to the insertion direction from the first position P1 while the detergent box is being inserted into the housing 10, and the second elastic member 840 disposed on the second side, which is different from the first side, of the detergent box 200, and configured to press the detergent box from the second position P2 that is spaced apart from the first position P1 with respect to the insertion direction while the detergent box is being inserted into the housing 10.

In the washing machine according to one embodiment, the first elastic member 740 may press the detergent box 200 from the first position to the third position P3 spaced apart from the second position with respect to the insertion direction, and the second elastic member 840 may press the detergent box 200 from the second position to the third position P3.

The washing machine according to one embodiment may further include the first moving bracket 720 coupled to the detergent box on the first side of the detergent box 200 and fixed to the second end 741 of the first elastic member, the first moving bracket 720 configured to move along the first guide rail 711, and the second moving bracket 820 coupled to the detergent box on the second side of the detergent box 200 and fixed to the second end 841 of the second elastic member, the second moving bracket 820 configured to move along the second guide rail 811.

The washing machine according to one embodiment may further include the first moving bracket 720 coupled to the detergent box on the first side of the detergent box 200 and configured to move along the first guide rail 711, and the second moving bracket 820 coupled to the detergent box on the second side of the detergent box 200 and configured to move along the second guide rail 811.

In the washing machine according to one embodiment, the second end 741 of the first elastic member 740 may be fixed to the first moving bracket 720, and the second end 841 of the second elastic member 840 may be fixed to the second moving bracket 820.

The washing machine according to one embodiment may further include the first guide pin 730 configured to couple the first moving bracket 720 to the detergent box 200 to allow the first moving bracket 720 to move along the first guide rail 711, and the second guide pin 830 configured to couple the second moving bracket 820 to the detergent box 200 to allow the second moving bracket 820 to move along the second guide rail 811.

The washing machine according to one embodiment may further include the first guide hole 712 formed in the first fixed bracket 710 along the front and rear direction to allow the first guide pin 730 to move, and the second guide hole 812 formed in the second fixed bracket 810 along the front and rear direction to allow the second guide pin 830 to move.

The washing machine according to one embodiment may include the first fixing hole 712*a* provided at the front end of the first guide hole 712 to fix the first guide pin 730 and formed at the first position, and the second fixing hole 812*a* provided at the front end of the second guide hole 812 to fix the second guide pin 830 and formed at the second position.

In the washing machine according to one embodiment, the first elastic member 740 and the second elastic member 840 may be provided in plurality along the vertical direction.

In the washing machine according to one embodiment, the detergent box hole 220 may be formed at the rear side of the detergent box 200, and the washing machine according to one embodiment may further include the detergent pump 400 disposed at the rear side of the detergent box 200 and configured to be docked to the detergent box 200 when the detergent box 200 is inserted to the housing 10.

In the washing machine according to one embodiment, the detergent pump 400 may further include the detergent suction part 520 configured to intake detergent stored in the detergent box 200 when the detergent pump 400 is docked to the detergent box 200, and the sealing member 550 formed in the detergent suction part 520 to seal the detergent box hole 220 when the detergent pump 400 is docked to the detergent box 200.

In the washing machine according to one embodiment, the sealing member 550 may be provided in plurality along the detergent suction part 520, and the first elastic member 740 and the second elastic member 840 may press the detergent box 200 to allow the plurality of sealing members 550 to be disposed inside the detergent box hole 220.

In the washing machine according to one embodiment, the first elastic member 740 may press the detergent box 200 from the first position to the third position P3 spaced apart from the second position with respect to the insertion direction, and the second elastic member 840 may press the detergent box 200 from the second position to the third position P3. The third position P3 may be a position to which the detergent box 200 and the detergent pump 400 are docked.

In the washing machine according to one embodiment, the first elastic member 740 and the second elastic member 840 may have different elastic modulus from each other.

In the washing machine according to one embodiment, the elastic modulus of the second elastic member 840 may be greater than the elastic modulus of the first elastic member 740.

The washing machine according to one embodiment may further include the detergent housing 140 accommodating the detergent box 200 and to which the first fixed bracket 710 and the second fixed bracket 810 are coupled.

In the washing machine according to one embodiment, the detergent box 200 may be configured to move relative to the housing 10 along the front and rear direction, and the first fixed bracket 710 and the second fixed bracket 810 may be disposed between the detergent housing 140 and the detergent box 200 along the left and right direction.

The washing machine according to one embodiment may further include the housing 10, the tub 20 disposed within the housing 10, and the detergent supply device 100 configured to supply detergent to the inside of the tub.

The detergent supply device 100 may include the detergent box 200 provided to store detergent, and configured to be withdrawn from the housing 10 or inserted into the housing 10, the detergent pump 400 including the detergent suction part 520 disposed at the rear of the detergent box 200 and extending toward the detergent box 200 to intake the detergent contained in the detergent box 200 when the detergent box 200 is docked, and the sealing member 551 formed in the detergent suction part 520, and the elastic members 740 and 840 configured to press the detergent box 200 backward when the detergent box 200 is withdrawn from the housing 10.

In the washing machine according to one embodiment, the elastic members 740 and 840 may include the first elastic member 740 disposed on the first side of the detergent box 200 and configured to press the detergent box backward from the first position P1, and the second elastic member 840 disposed on the second side of the detergent box 200 and configured to press the detergent box from the second position P2 rearwardly spaced from the first position.

In the washing machine according to one embodiment, the first elastic member 740 may press the detergent box 200 from the first position to the third position at the rear of the second position, and the second elastic member 840 may press the detergent box 200 from the second position to the third position.

In the washing machine according to one embodiment, while the detergent box 200 is being inserted into the housing 10, the detergent box 200 may come into contact with the sealing member 551 at the fourth position located between the second position and the third position with respect to the front and rear direction.

The washing machine according to one embodiment may include the housing 10, the tub 20 disposed within the housing 10, the detergent box 200 configured to be withdrawn from the housing 10 or inserted into the housing 10, the first elastic member 740 disposed on the first side of the detergent box 200 and having a first elastic modulus to press the detergent box 200 rearward from the first position P1 while the detergent box 200 is being inserted into the housing 10, and the second elastic member 840 disposed on the second side of the detergent box 200 and having a second elastic modulus greater than the first elastic modulus so as to press the detergent box 200 rearward from the second position P2 at the rear of the first position P1 while the detergent box 200 is being inserted into the housing 10

In the washing machine according to one embodiment, the first elastic member 740 may press the detergent box 200 from the first position to the third position at the rear of the second position, and the second elastic member 840 may press the detergent box 200 from the second position to the third position.

The washing machine according to one embodiment may include the first fixed bracket 710 disposed on the first side of the detergent box 200 and to which the first end 742 of the first elastic member 740 is fixed, the first fixed bracket 710 on which the first guide rail is formed, the second fixed bracket 810 disposed on the second side of the detergent box 200 and to which the first end 842 of the second elastic member 840 is fixed, the second fixed bracket 810 on which the second guide rail is formed, the first moving bracket 720 coupled to the detergent box 200 on the first side of the detergent box 200 and to which the second end 741 of the first elastic member 740 is fixed, the first moving bracket 720 configured to move along the first guide rail, and the second moving bracket 820 coupled to the detergent box 200 on the second side of the detergent box 200 and to which the second end 841 of the second elastic member 840 is fixed, the second moving bracket 820 configured to move along the second guide rail.

While the present disclosure has been particularly described with reference to exemplary embodiments, it should be understood by those of skilled in the art that various changes in form and details may be made without departing from the spirit and scope of the present disclosure.

The invention claimed is:

1. A washing machine comprising:

a housing;

a tub in the housing;

a detergent box configured to move out of the housing in a withdrawal direction and move into the housing in an insertion direction, and including a detergent storage space to store therein a detergent to be supplied to the tub, a first elastic member on a first side of the detergent box, and a second elastic member on a second side of the detergent box, wherein the first elastic member and the second elastic member are configured so that, in response to the detergent box being moved into the housing in the insertion direction, the first elastic member presses the detergent box in the insertion direction away from a first position within the housing and the second elastic member presses the detergent box in the insertion direction away from a second position within the housing and where the second position is spaced from the first position in the insertion direction, and, in response to the detergent box being moved out of the housing in the withdrawal direction, the first elastic member and the second elastic member press the detergent box in the insertion direction.

2. The washing machine of claim 1, wherein in response to the detergent box being moved into the housing in the insertion direction, the first elastic member presses the detergent box in the insertion direction from the first position to a third position spaced from the second position in the insertion direction, and the second elastic member presses the detergent box in the insertion direction from the second position to the third position.

3. The washing machine of claim 2, further comprising:

a first fixed bracket on the first side of the detergent box to which a first end of the first elastic member is fixed; and a second fixed bracket on the second side of the detergent box to which a first end of the second elastic member is fixed.

4. The washing machine of claim 3, further comprising:

a detergent housing to accommodate the detergent box and to which the first fixed bracket and the second fixed bracket are coupled.

5. The washing machine of claim 4, wherein the detergent box is moveable relative to the detergent housing along the insertion direction and the withdrawal direction, and the first fixed bracket is disposed between the detergent housing and the detergent box along the first side of the detergent box and the second fixed bracket is disposed between the detergent housing and the detergent box along the second side of the detergent box.

6. The washing machine of claim 3, further comprising:

a first guide rail formed in the first fixed bracket;

a second guide rail formed in the second fixed bracket;

a first moving bracket coupled to the first side of the detergent box and to which a second end of the first elastic member is fixed, the first moving bracket being moveable along the first guide rail of the first fixed bracket; and a second moving bracket coupled to the second side of the detergent box and to which a second end of the second elastic member is fixed, the second moving bracket being moveable along the second guide rail of the second fixed bracket.

7. The washing machine of claim 6, further comprising:

a first guide pin coupling the first moving bracket to the detergent box so that the first moving bracket and the detergent box are moveable along the first guide rail; and a second guide pin coupling the second moving bracket to the detergent box so that the second moving bracket and the detergent box are moveable along the second guide rail.

8. The washing machine of claim 7, further comprising:

a first guide hole formed in the first fixed bracket so that the first guide pin is moveable along the first guide hole; and a second guide hole formed in the second fixed bracket so that the second guide pin is moveable along the second guide hole.

9. The washing machine of claim 8, further comprising:

a first fixing hole at a front end of the first guide hole and formed at the first position, the first fixing hole configured to fix the first guide pin in response to the detergent box moved in the withdrawal direction from the first position; and a second fixing hole at a front end of the second guide hole and formed at the second position, the second fixing hole configured to fix the second guide pin in response to the detergent box moved in the withdrawal direction from the second position.

10. The washing machine of claim 9, wherein the first elastic member includes a plurality of first elastic members, at least one of the plurality of first elastic members is fixed to an upper portion of the first fixed bracket, and at least one other of the plurality of first elastic members is fixed to a lower portion of the first fixed bracket, and the second elastic member includes a plurality of second elastic members, at least one of the plurality of second elastic members is fixed to an upper portion of the second fixed bracket, and at least one other of the plurality of second elastic members is fixed to a lower portion of the second fixed bracket.

11. The washing machine of claim 1, further comprising:

a detergent pump including:

a detergent suction part, and a sealing member formed in the detergent suction part, and wherein the detergent box further includes:

a detergent box hole formed at a rear side of the detergent box, and wherein the detergent box docks to the detergent pump so that the sealing member seals the detergent box hole and the detergent suction part is configured to intake detergent stored in the detergent box in response to the detergent box being moved into the housing in the insertion direction.

12. The washing machine of claim 11, wherein the sealing member includes a plurality of sealing members disposed in the detergent suction part, and the first elastic member and the second elastic member press the detergent box so that the plurality of sealing members are pressed inside the detergent box hole.

13. The washing machine of claim 12, wherein the first elastic member presses the detergent box from the first position to a third position spaced rearward of the second position, the second elastic member presses the detergent box from the second position to the third position, and the third position is where the detergent box is docked to the detergent pump.

14. The washing machine of claim 1, wherein the first elastic member and the second elastic member have different elastic moduli.

15. The washing machine of claim 1, wherein an elastic modulus of the second elastic member is greater than an elastic modulus of the first elastic member.

* * * * *